US005858594A

United States Patent [19]

Notsu et al.

[11] Patent Number: 5,858,594

[45] Date of Patent: Jan. 12, 1999

[54] ELECTROPHOTOGRAPHIC PHOTORECEPTOR

[75] Inventors: Shusuke Notsu; Akihiko Yagishita; Masayuki Hiroi, all of Kanagawa, Japan

[73] Assignee: Mitsubishi Chemical Corporation, Tokyo, Japan

[21] Appl. No.: 864,406

[22] Filed: May 28, 1997

[30] Foreign Application Priority Data

May 29, 1996 [JP] Japan ..... 8-134960

[51] Int. Cl.[6] ..... G03G 5/09

[52] U.S. Cl. ..... 430/78; 430/58

[58] Field of Search ..... 430/58, 59, 73, 430/75, 76, 78

[56] References Cited

U.S. PATENT DOCUMENTS

| | | | |
|---|---|---|---|
| H1474 | 8/1995 | Martin et al. | 430/78 |
| 4,353,971 | 10/1982 | Chang et al. | 430/58 |
| 5,013,625 | 5/1991 | Takizawa et al. | 430/64 |
| 5,102,757 | 4/1992 | Akasaki et al. | 430/58 |
| 5,190,839 | 3/1993 | Fujimaki et al. | 430/78 |
| 5,347,303 | 9/1994 | Kovacs et al. | 346/157 |

FOREIGN PATENT DOCUMENTS

| | | |
|---|---|---|
| 0 658 814 | 6/1995 | European Pat. Off. . |
| 0 666 507 | 8/1995 | European Pat. Off. . |
| 30 34 564 | 3/1981 | Germany . |
| WO 93/21565 | 10/1993 | WIPO . |

*Primary Examiner*—John Goodrow
*Attorney, Agent, or Firm*—Oblon, Spivak, McClelland, Maier & Neustadt, P.C.

[57] ABSTRACT

An electrophotographic photoreceptor comprising an electroconductive substrate and at least a photosensitive layer formed on the substrate, wherein the photosensitive layer contains a carrier generation material having a sensitivity in a near-infrared wavelength region and a coloring matter having no substantial sensitivity in a visible light region and a near-infrared wavelength region.

12 Claims, 17 Drawing Sheets

ELECTROPHOTOGRAPHIC PHOTORECEPTOR

The present invention relates to an electrophotographic photoreceptor, particularly it relates to an electrophotographic photoreceptor useful for e.g. printers wherein a semiconductor laser beam or a LED array beam is used as the light source.

Since phthalocyanine compounds were found to have excellent photoconductivity, various studies have been made thereon as photoelectric transfer materials, and they have been used, for example, for electrophotographic photoreceptors. In recent years, researches and developments have been very active for laser beam printers or LED printers wherein a laser beam or a LED array beam is used as the light source instead of conventional white light and which have merits in the high speed, high image quality and non-impact characteristics. Especially, recent developments in the semiconductor laser are remarkable, and a compact stabilized laser generator is available at a low price. Further, with respect to the LED array, a highly fine array with high integration to a level of 128 dots per element, has been made possible, and such an array is being used as a light source for electrophotography. The wavelength of such a semiconductor laser or a LED array light source is from 600 to 900 nm, and a photoreceptor having a high sensitivity to light in this wavelength range is strongly desired. As organic photoconductive materials to satisfy this demand, squalic acid, methine coloring matters, cyanine coloring matters, pyrylium coloring matters, thiapyrylium coloring matters, polyazo coloring matters and phthalocyanine coloring matters are, for example, known. Among them, squalic acid, methine coloring matters, cyanine coloring matters, pyrylium coloring matters and thiapyrylium coloring matters are relatively easy to adapt their spectral sensitivity to a long wavelength range, but they lack in practical stability for repeated use. Polyazo coloring matters are difficult to adjust their absorption to a long wavelength range, and they are also difficult to produce. On the other hand, phthalocyanine coloring matters can relatively easily be synthesized and have absorption peaks in a wavelength range of at least 600 nm, and, as compared with other coloring matters, their absorption wavelengths extend to a relatively long wavelength region in many cases, whereby they have been expected and widely studied for carrier generation materials for long wavelength light sources.

Phthalocyanines are different in the absorption spectrum or photoconductivity depending upon the types of the central metals. Not only that, their physical properties are different also depending upon the crystal forms, and some instances have been reported in which among phthalocyanines having the same central metal, a certain specific crystal form is selected for use for an electrophotographic photoreceptor. For example, oxytitanium phthalocyanine has various crystal forms, and it has been reported that there is a substantial difference in the electrical chargeability, dark decay or sensitivity depending upon the crystal forms. JP-A-59-49544 discloses that as a crystal form of oxytitanium phthalocyanine, preferred is the one which presents strong diffraction peaks at Bragg angles ($2\theta \pm 0.2$) of 9.2°, 13.1°, 20.7°, 26.2° and 27.1°, and an X-ray diffraction spectrum is shown. Further, JP-A-59-166959 discloses that a vapor deposited film of oxytitanium phthalocyanine is left to stand in a saturated vapor of tetrahydrofuran for from 1 to 24 hours to change the crystal form, to obtain a carrier generation layer. The X-ray diffraction spectrum is disclosed to have a small number of peaks which are broad in width and to show strong diffraction peaks at Bragg's angles (20) of 7.5°, 12.6°, 13.0°, 25.4°, 26.2° and 28.6°.

However, the sensitivity of an electrophotographic photoreceptor is substantially straightforwardly determined by the photoconductive material employed and does not necessarily agree to the photosensitivity required by the light source for exposure, whereby a problem such as broadening or narrowing of letters or deterioration in resolution is likely to result. For example, when the sensitivity is too high to the light source for exposure, broadening of letters will result, and the resolution tends to be poor. Further, consumption of the toner will increase, and the useful life will be affected. Thus, such will present a restriction to construction of an image-forming process to obtain an image of high quality.

To change the photosensitivity of a photoreceptor, a method is, for example, known in which the binder resin or the organic solvent to be used, is changed in a case where the photoconductive material is used in a dispersion method. However, such a binder resin or an organic solvent useful for the construction of a photoreceptor is rather limited, whereby it is practically difficult to change the sensitivity as the case requires.

Further, some cases have been reported in which a plurality of phthalocyanines are used in combination to adjust the photosensitivity. For example, JP-A-62-272272 discloses a combination of α-form oxytitanium phthalocyanine and β-form oxytitanium phthalocyanine, JP-A-2-183261 discloses a method for adjusting the sensitivity by mixing oxytitanium phthalocyanine having difference crystal forms, such as oxytitanium phthalocyanine having a crystal form which shows peaks at Bragg angles ($2\theta$) of 9.6°, 11.7°, 24.1° and 27.2° and oxytitanium phthalocyanine having a crystal form which shows peaks at Bragg's angles of 6.9°, 15.5° and 23.4° and by changing the mixing ratio, and JP-A-2-280169 discloses a method for adjusting the sensitivity by mixing to oxytitanium phthalocyanine a different type of phthalocyanine such as metal free phthalocyanine or copper phthalocyanine.

However, with the photoreceptors disclosed in these cases, the range for adjustment of the sensitivity is narrow, whereby the photosensitivity can be adjusted only to the photosensitivity of a certain specific light source for exposure, or there will be a problem such that change in the potential is large when they are used repeatedly, and they were not practically satisfactory.

It is an object of the present invention to provide an electrophotographic photoreceptor, whereby the sensitivity of an electrophotographic photoreceptor to be used for an image-forming process comprising a step of spot exposure by an exposure beam to form an electrostatic latent image and a step of developing this electrostatic latent image with a developer, is adjusted to the sensitivity required by the light source for exposure used here, so that the image will be sharp.

The above object of the present invention can be accomplished by incorporating a carrier generation material having a sensitivity in a near-infrared wavelength region and a coloring matter having no substantial sensitivity in a visible light region and a near-infrared wavelength region in an optional ratio to a photosensitive layer of an electrophotographic photoreceptor. Namely, the present invention provides an electrophotographic photoreceptor comprising an electroconductive substrate and at least a photosensitive layer formed on the substrate, wherein the photosensitive layer contains a carrier generation material having a sensitivity in a near-infrared wavelength region and a coloring matter having no substantial sensitivity in a visible light region and a near-infrared wavelength region.

Here, the near-infrared wavelength region means a wavelength range of from about 600 nm to about 900 nm. More particularly, it is a range which covers oscillating wavelengths (such as 780 nm, 830 nm, 680 nm and 660 nm) of a semiconductor laser or a LED array which is used as a light source for a laser printer or a LED printer.

Figure 1:
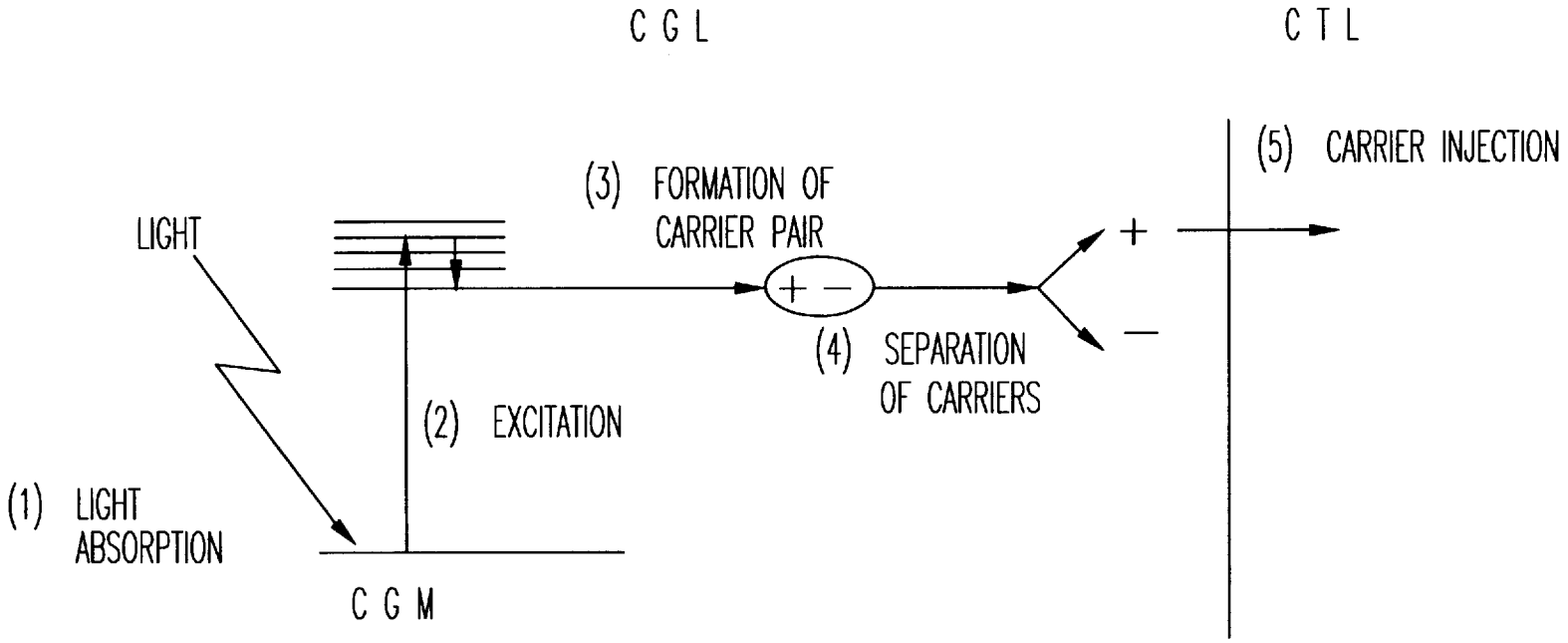
FIG. 1 is a diagrammatical view illustrating a carrier-forming process by a carrier generation material.
Figure 2:
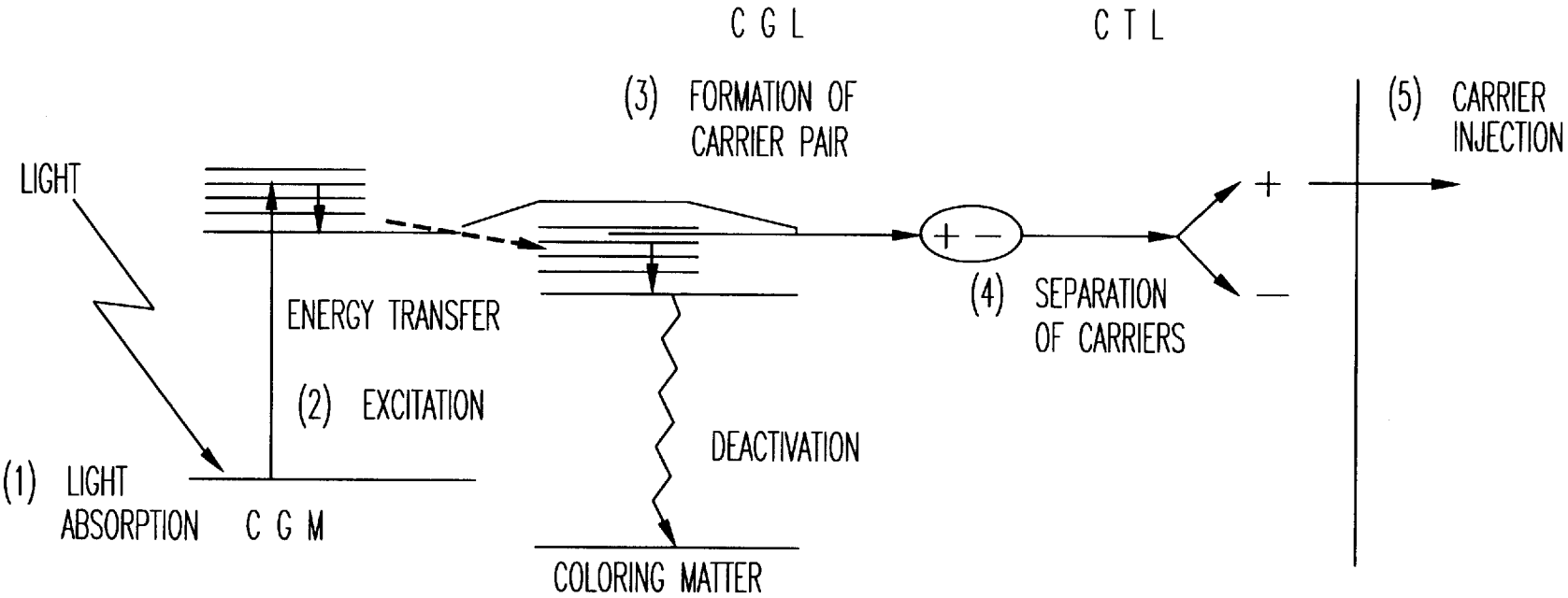
FIG. 2 is a diagrammatical view illustrating the mechanism for lowering the sensitivity according to the present invention.

Now, the present invention will be described in detail with reference to the preferred embodiments.

The carrier generation material having a sensitivity in a near-infrared wavelength region to be used in the present invention may be a known carrier generation material such as squalic acid, a methine coloring matter, a cyanine coloring matter, a pyrylium coloring matter, a thiapyrylium coloring matter, a polyazo coloring matter or a phthalocyanine coloring matter. There carrier generation materials may be used alone or in combination as a mixture of two or more of them.

Among them, a phthalocyanine pigment such as metal-free phthalocyanine or metal phthalocyanine, is preferred. The metal phthalocyanine may be a phthalocyanine having a central metal such as Cu, Co, Pb, Fe, Mg, Ga, Ni, Cr, Zr, Ti, V, Mn, Pt, In, Al, Si, Ge or Sn. Here, the central metal may have, as a substituent, oxygen, a hydroxyl group, an alkoxy group such as a methoxy group, an ethoxy group or a propoxy group, or a halogen atom such as fluorine, chlorine or bromine.

Further among these phthalocyanine pigments, oxytitanium phthalocyanine is more preferred.

Now, oxytitanium phthalocyanine which is preferably used in the present invention, will be described in more detail.

The oxytitanium phthalocyanine to be preferably used in the present invention, may, for example, be the one represented by the following formula (VII):

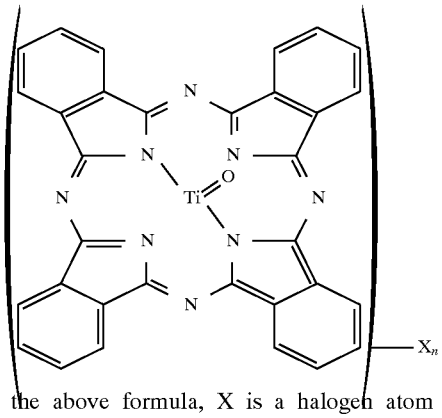

(VII)

In the above formula, X is a halogen atom such as chlorine or bromine, and n is a number of from 0 to 1.

In the above formula (VII), X is preferably a chlorine atom, and n is preferably from 0 to 0.5.

The oxytitanium phthalocyanine to be used in the present invention can readily be prepared, for example, from 1,2-dicyanobenzene (orthophthalodinitrile) and a titanium compound, for example, by a reaction represented by the following scheme (1) or (2).

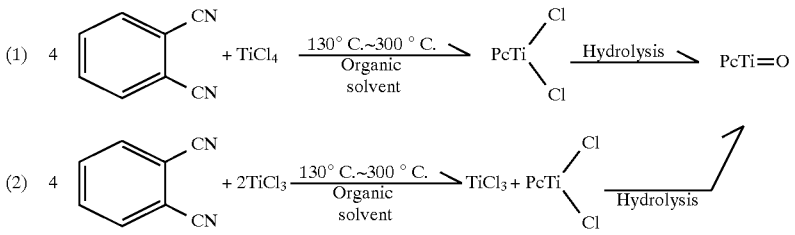

wherein Pc is a phthalocyanine residue.

Namely, 1,2-dicyanobenzene and a titanium halide are heated and reacted in an inert solvent. As the titanium compound, titanium tetrachloride, titanium trichloride or titanium tetrabromide may, for example, be used. As the inert solvent, a high boiling organic solvent inert to the reaction, such as trichlorobenzene, α-chloronaphthalene, β-chloronaphthalene, βmethylnaphthalene, methoxynaphthalene, diphenyl ether, diphenyl methane, diphenyl ethane, ethylene glycol dialkyl ether, diethylene glycol dialkyl ether or triethylene glycol dialkyl ether, may, for example, be preferably used. These solvents may be used alone or in combination as a mixture of two or more of them. The reaction temperature is usually from 150° to 300° C., preferably from 180° to 250° C. After the reaction, formed dichlorotitanium phthalocyanine is collected by filtration and washed with a solvent used for the reaction to remove impurities formed by the reaction or unreacted starting material.

Then, it is washed with an inert solvent, for example, an alcohol such as methanol, ethanol or isopropyl alcohol, or an ether such as tetrahydrofuran or diethyl ether, to remove the solvent used for the reaction. Then, the obtained dichlorotitanium phthalocyanine is subjected to organic solvent treatment and hydrolytic treatment to obtain oxytitatium phthalocyanine. For example, by the organic solvent treatment as disclosed in JP-A-2-308863, JP-A-3-50270 or JP-A-3-59077, the desired crystal form oxytitanium phthalocyanine can be obtained directly from dichlorotitanium phthalocyanine. Further, oxytitanium phthalocyanine obtained by hydrolytic treatment is subjected to hot water treatment as disclosed in JP-A-6267094 or mechanical crashing treatment as disclosed in JP-A-2-215866 to obtain the desired crystal form.

Further, the oxytitanium phthalocyanine to be preferably used in the present invention is not limited to the oxytitanium phthalocyanine produced by the above described method. For example, it can be produced from other crystal type oxytitatium phthalocyanine by suitable treatment, and any oxytitatium phthalocyanine produced by any method may suitably be used as the oxytitanium phthalocyanine in the present invention.

In the present invention, the coloring matter to be incorporated together with the carrier generation material to the photosensitive layer may be any coloring matter so long as it has no substantial sensitivity in a visible light region and near-infrared wavelength region. For example, various known dyes, pigments and coloring matters of e.g. indigo type, thioindigo type, anthraquinone type, indanthrene type, azo type, azolake type, bisazo type, triphenyl methane type, cyanine type, heterocyclic type and condensed polycyclic type, may be used. Among these, particularly preferred is a coloring matter which has a half value exposure sensitivity in a visible light region and near-infrared wavelength region of at least 10 Lux·sec, and wherein in the visible light region and near-infrared light absorption spectrum of the coloring matter, the maximum absorption wavelength (λmax) is within a range of from 300 nm and 650 nm, and an absorbance at 700 nm (Abs (700 nm)) and the absorbance at αmax satisfy a relation represented by the following formula:

$$\text{Abs (700 nm)}/\text{Abs }(\lambda\text{max}) \leqq 0.1$$

Preferred as the coloring matter for the present invention is an anthraquinone compound, an azolake compound, a triarylmethane compound having at least one amino group, a monoazo compound having at least one coupler having a phenolic hydroxyl group, a cyanine compound having an indoline ring as a heteroring, or a naphthalic acid imide compound.

Further, an anthraquinone compound of the following formula (1) may be mentioned as a preferred coloring matter of the present invention.

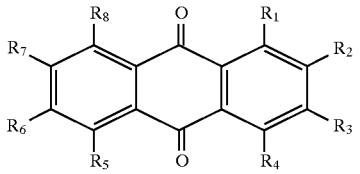

(I)

In the above formula, at least one of $R_1$ to $R_8$ is a hydroxyl group. The rest is a hydrogen atom, a substituted or unsubstituted alkyl group such as methyl, ethyl or propyl, a substituted or unsubstituted alkoxy group such as methoxy, ethoxy or propoxy, a substituted or unsubstituted phenoxy group, a substituted or unsubstituted amino group such as an alkylamino group, a dialkylamino group, an arylamino group, an alkylarylamino group or a diarylamino group, a sulfonic acid group, a sulfonate group or a halogen atom such as fluorine or chlorine.

Some specific examples of the hydroxy anthraquinone compound of the structure of the above formula (I) will be shown in the following Table 1. Of course, the present invention is not limited to these specific examples.

TABLE 1

| | R1 | R2 | R3 | R4 | R5 | R6 | R7 | R8 |
|---|---|---|---|---|---|---|---|---|
| No.1 | −OH | −OH | −H | −H | −H | −H | −H | −H |
| No.2 | −OH | −OH | −H | −OH | −OH | −H | −H | −OH |
| No.3 | −OH | −OH | $-SO_3Na$ | −H | −H | −H | −H | −H |
| No.4 | $-OCH_3$ | −OH | −H | −H | −H | −H | −H | −H |
| No.5 | −OH | 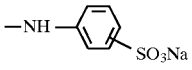 | −H | 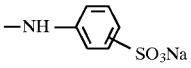 | −H | −H | −H | −H |
| No.6 | −OH | −H | 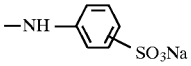 | 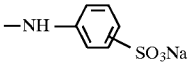 | −H | −H | −H | −H |
| No.7 | −OH | $-SO_3Na$ | −H | $-NH_2$ | −OH | $-SO_3Na$ | −H | $-NH_2$ |
| No.8 | −OH | −H | −H | $-NH_2$ | −OH | $-SO_3Na$ | −H | $-NH_2$ |
| No.9 | −OH | −OH | −OH | −H | −H | −H | −H | −H |
| No.10 | $-OCH_3$ | −OH | $-OCH_3$ | −H | −H | −H | −H | −H |

TABLE 1-continued

| | R1 | R2 | R3 | R4 | R5 | R6 | R7 | R8 |
|---|---|---|---|---|---|---|---|---|
| No.11 | −OH | −H | −H | 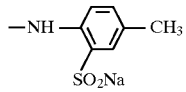 | −H | −H | −H | −H |
| No.12 | −OH | −H | 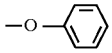 | $-NH_2$ | −H | −H | −H | −H |

An azolake compound of the following formula (II) may be mentioned as another preferred coloring matter in the present invention.

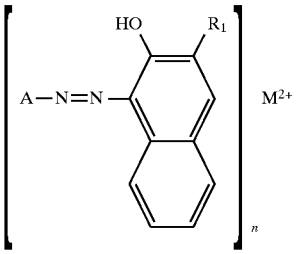

(II)

In the above formula, n is 1 or 2, M is Ca, Ba or Mn, $R_1$ is a hydrogen atom, $SO_3^-$ or $COO^-$, and A is a coupler residue of the following formula (B) or (C).

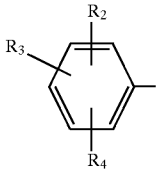

(B)

In the above formula, $R_2$ is a hydrogen atom, $SO_3^-$ or $COO^-$. Each of $R_3$ and $R_4$ is a hydrogen atom, a halogen atom such as fluorine or chorine, or a substituted or unsubstituted alkyl group having from 1 to 4 carbon atoms, for example, an alkyl group such as a methyl group, an ethyl group, a n-propyl group, an i-propyl group, a n-butyl group or a t-butyl group.

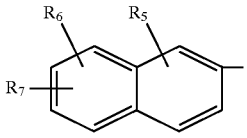

(C)

In the above formula, $R_5$ is a hydrogen atom, $SO_3^-$ or $COO^-$, each of $R_6$ and $R_7$ is a hydrogen atom, a halogen atom such as fluorine or chlorine, or a substituted or unsubstituted alkyl group having from 1 to 4 carbon atoms, for example, an alkyl group such as a methyl group, an ethyl group, a n-propyl group, an i-propyl group, a n-butyl group or a t-butyl group.

Some specific examples of the azolake compound having a structure of the above formula (II) will be shown in the following Table 2. Of course, the present invention is not limited to such specific examples.

TABLE 2

No. 1

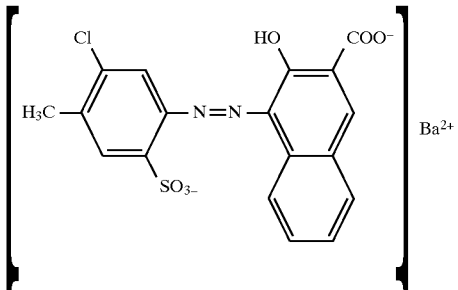

No. 2

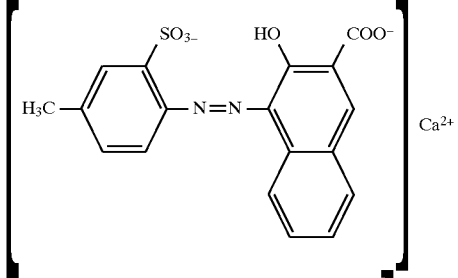

No. 3

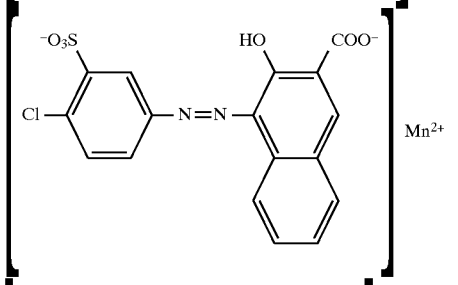

No. 4

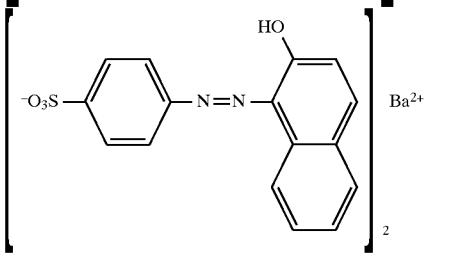

No. 5

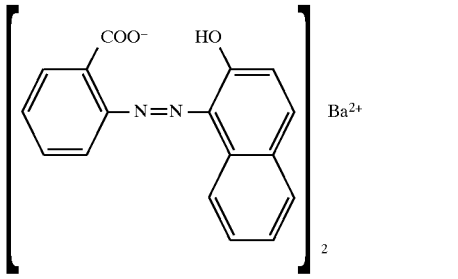

TABLE 2-continued

No. 6

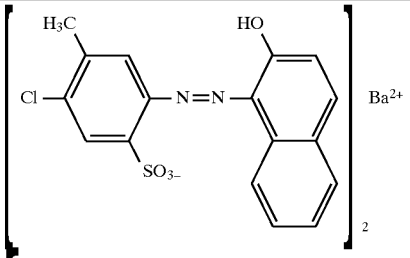

No. 7

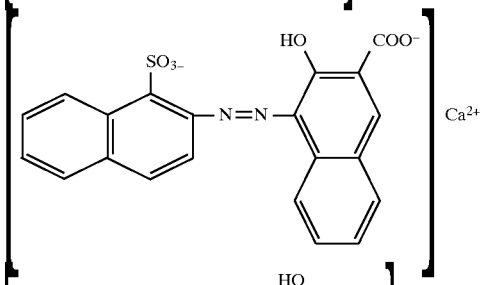

No. 8

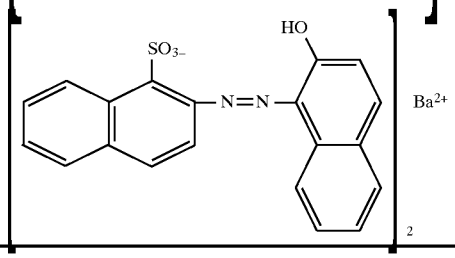

Further, a triaryl methane compound of the following formula (III) may be mentioned as another preferred coloring matter for the present invention.

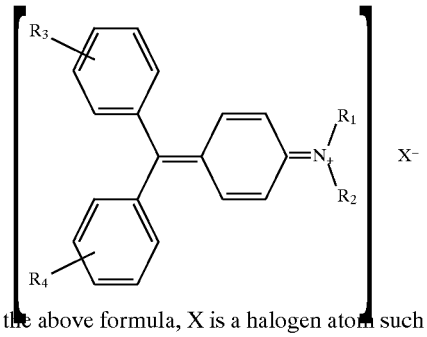

(III)

In the above formula, X is a halogen atom such as fluorine or chlorine, each of $R_1$ and $R_2$ is a hydrogen atom, a substituted or unsubstituted alkyl group having from 1 to 4 carbon atoms, e.g. an alkyl group such as a methyl group, an ethyl group, a n-propyl group, an i-propyl group, a n-butyl group or a t-butyl group, and each of $R_3$ and $R_4$ is a hydrogen atom, a halogen atom such as fluorine or chlorine, or a substituted or unsubstituted amino group such as an alkylamino group, a dialkylamino group, an arylamino group, an alkylarylamino group or a diarylamino group.

Some specific examples of the triaryl methane compound having the structure of the above formula (III) will be shown in the following Table 3. Of course, the present invention is by no means restricted to such specific examples.

TABLE 3

No. 1

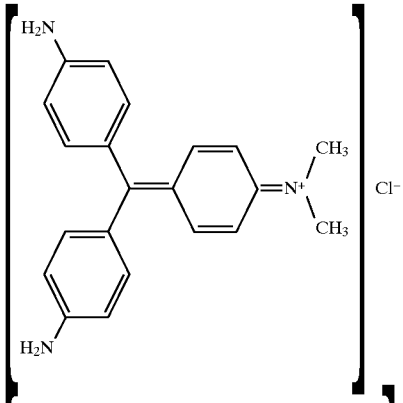

No. 2

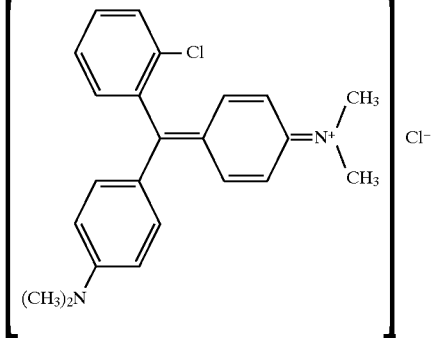

No. 3

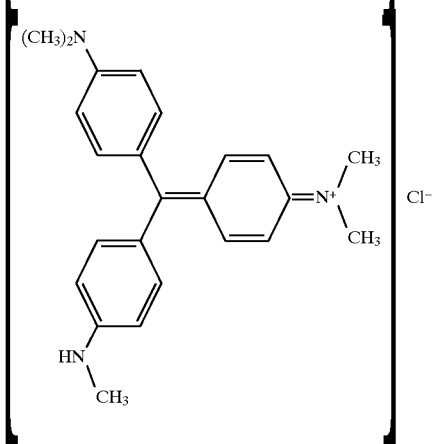

No. 4

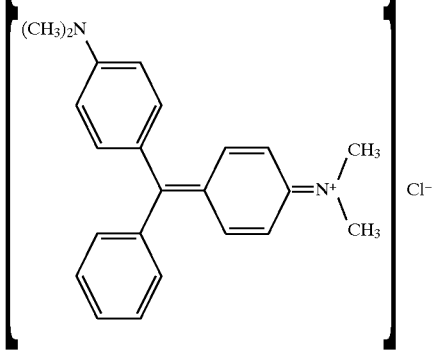

TABLE 3-continued

| | |
|---|---|
| No. 5 | 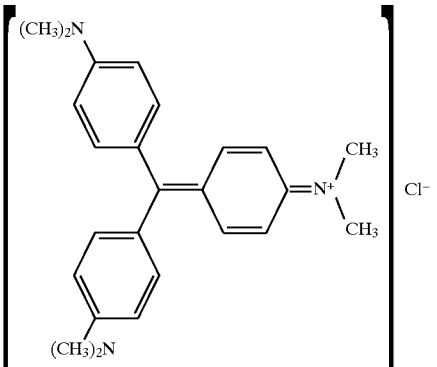 |
| No. 6 | 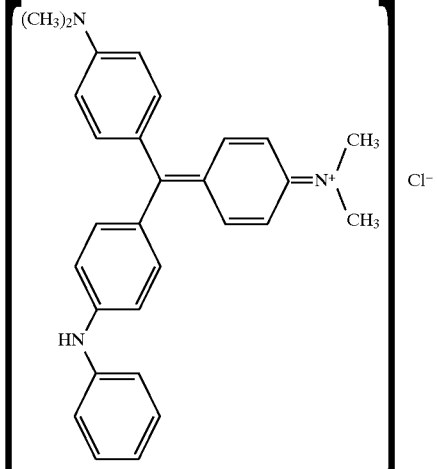 |

Further, a monoazo compound of the following formula (IV) may be mentioned as another preferred coloring matter for the present invention.

D–N=N–E (IV)

In the above formula, each of D and E is a substituted or unsubstituted aromatic ring, aromatic heterocyclic ring or condensed polycyclic residue. Further, D and E may be the same or different.

Specific examples of the structures of D and E of the azo compound of the above formula (IV) will be shown in the following Table 4. Of course, the present invention is by no means restricted to such specific examples.

TABLE 4-1

| | |
|---|---|
| D-1 | 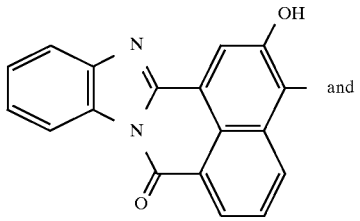 and 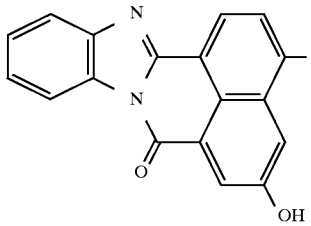 |
| 2 | 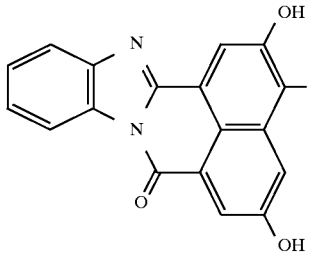 |
| 3 | 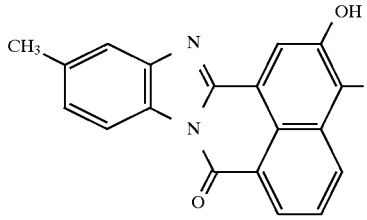 and 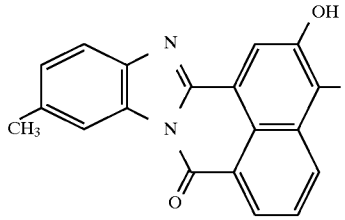 |
| 4 | 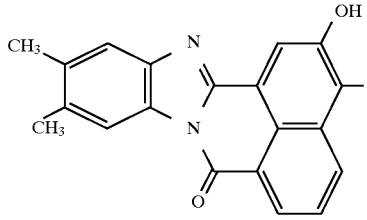 |

TABLE 4-1-continued
5
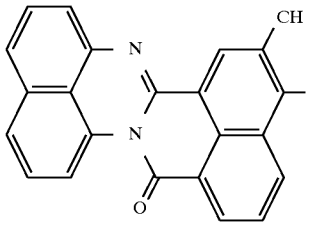
6
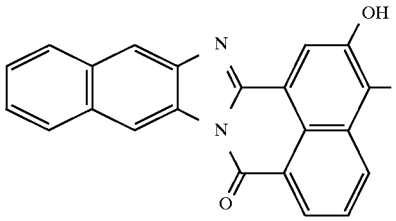
7
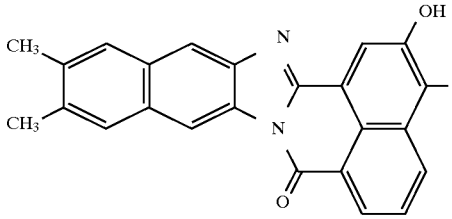
8
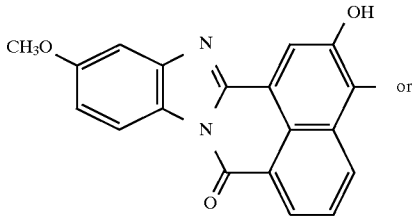
or
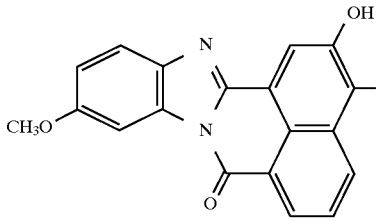
9
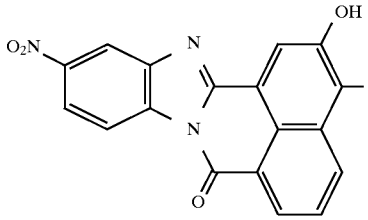
or
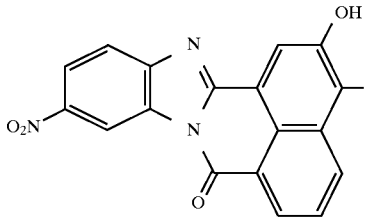
TABLE 4-1-continued
10
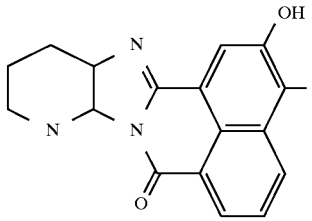
or
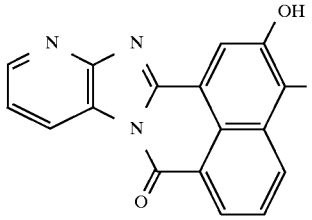
11
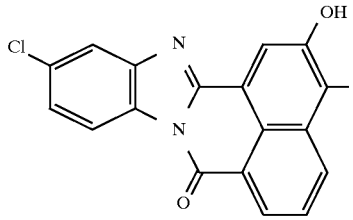
or
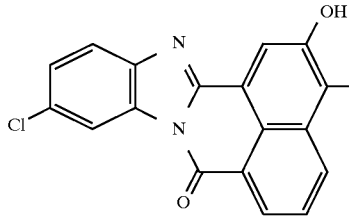
12
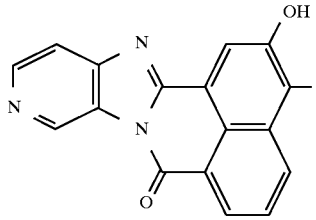
or
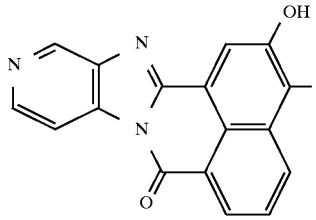

TABLE 4-1-continued
13
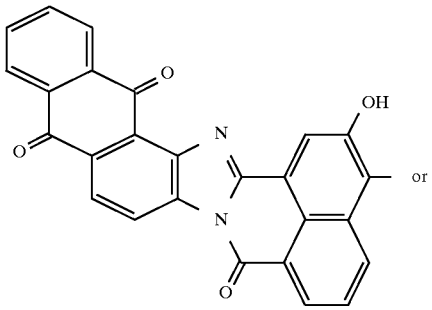
or
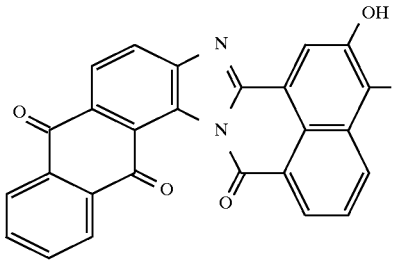
14
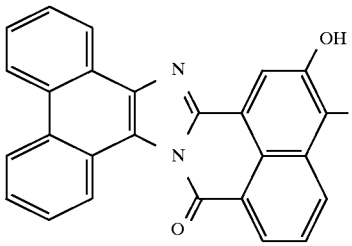
TABLE 4-2
15
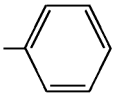
16
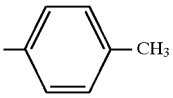
17
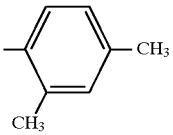
18
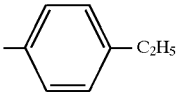
19
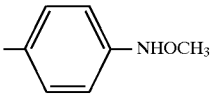
20
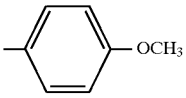
TABLE 4-2-continued
21
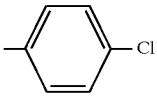
22
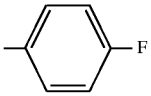
23
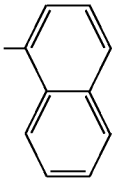
24
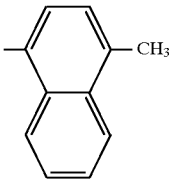
25
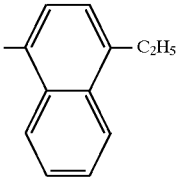
26
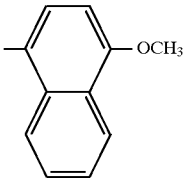
27
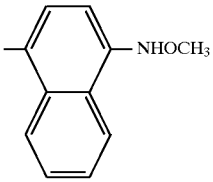
28
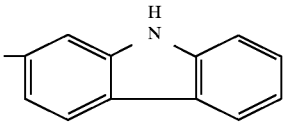
TABLE 4-3
29
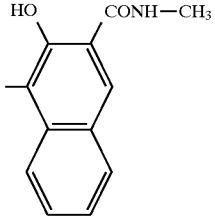

TABLE 4-3-continued
30
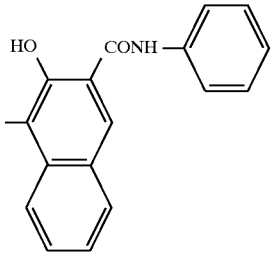
31
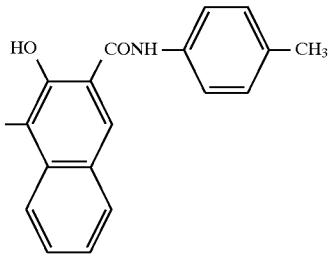
32
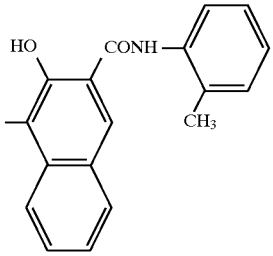
33
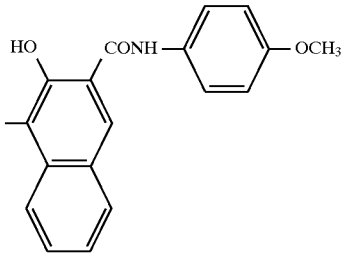
34
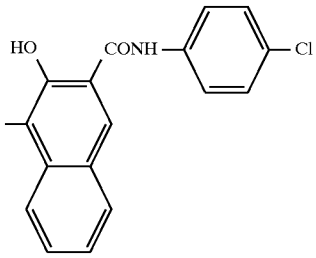
35
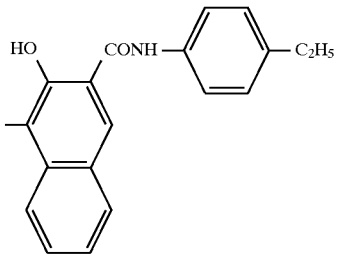
TABLE 4-3-continued
36
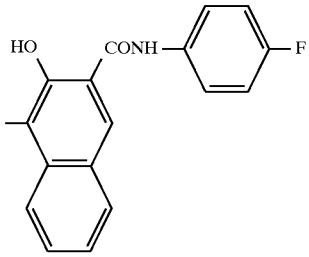
37
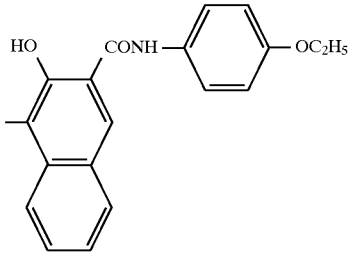
38
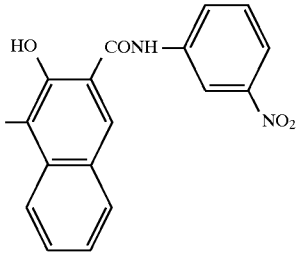
39
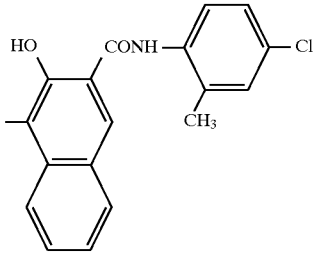
40
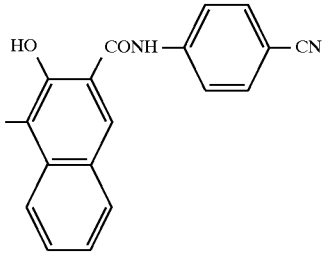
41
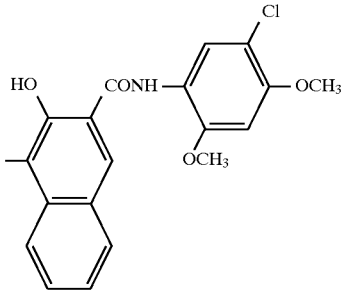

TABLE 4-3-continued
42
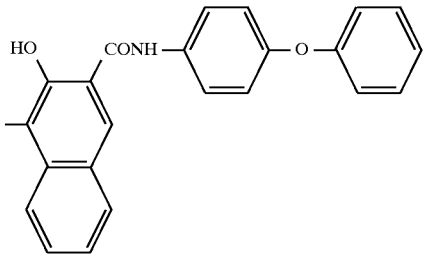
TABLE 4-4
43
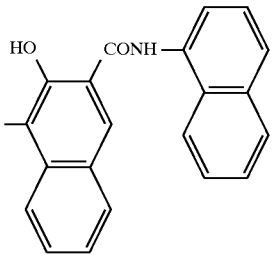
44
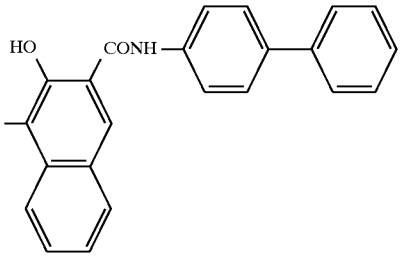
45
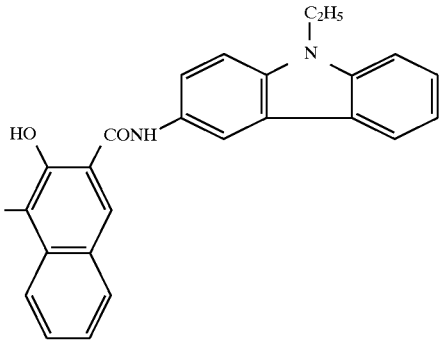
46
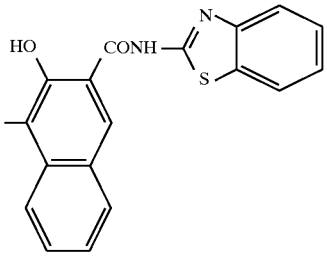
TABLE 4-4-continued
47
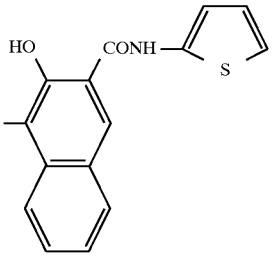
48
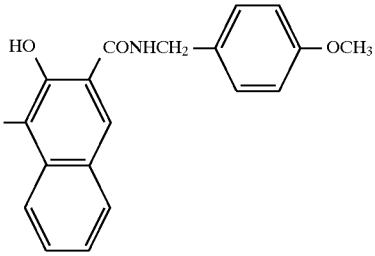
49
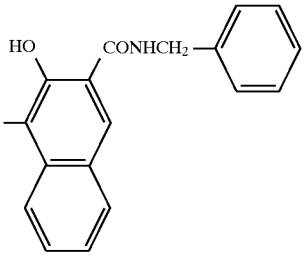
50
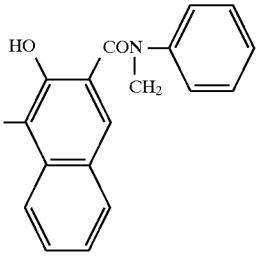
51
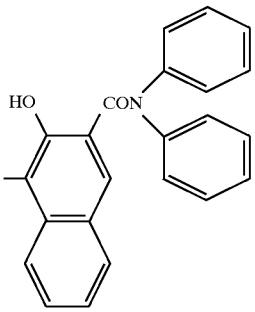

TABLE 4-4-continued
52
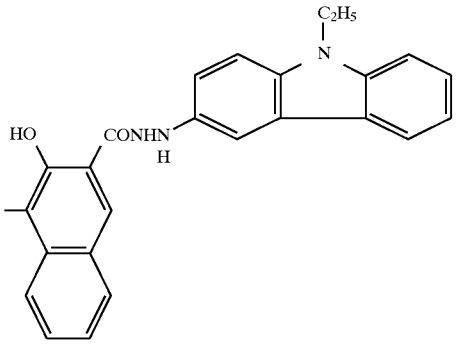
53
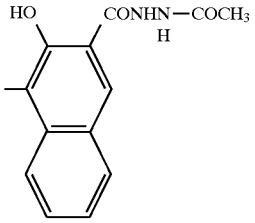
54
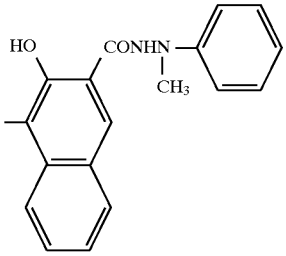
55
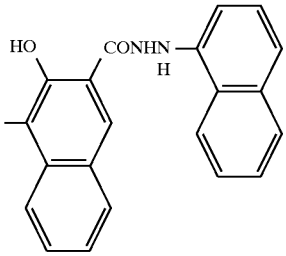
56
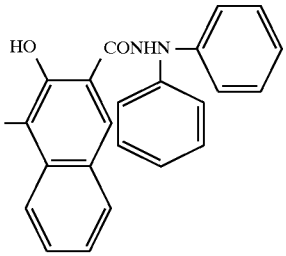
TABLE 4-5
57
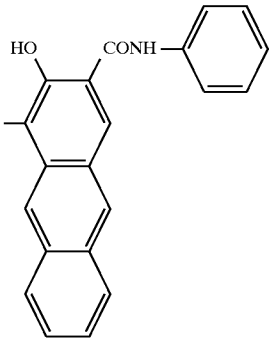
58
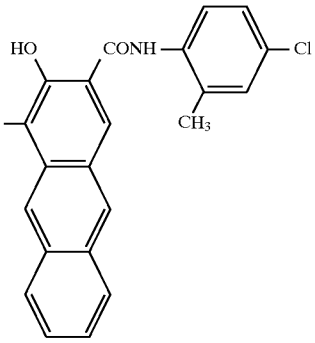
59
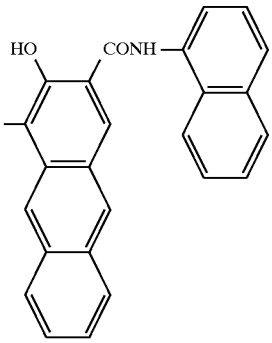
60
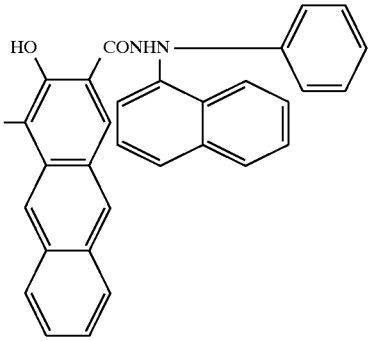

TABLE 4-5-continued
61
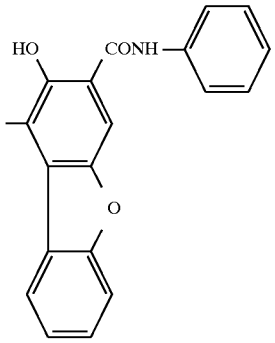
62
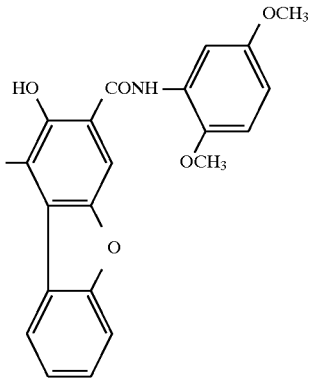
63
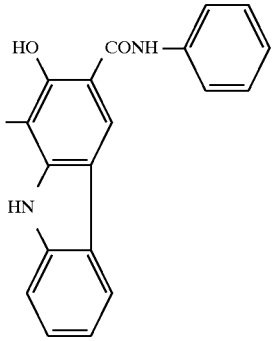
64
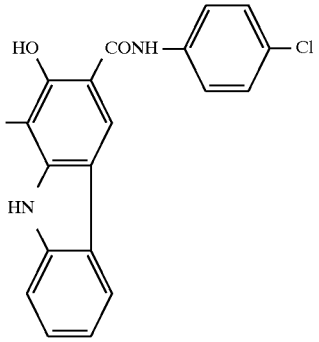
TABLE 4-5-continued
65
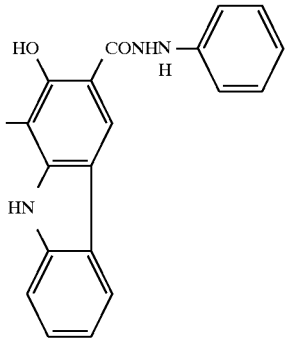
66
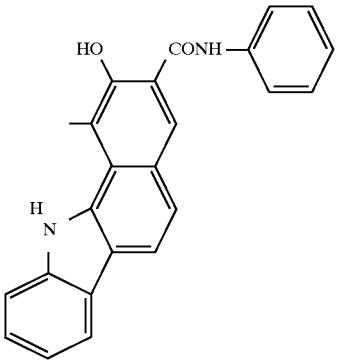
67
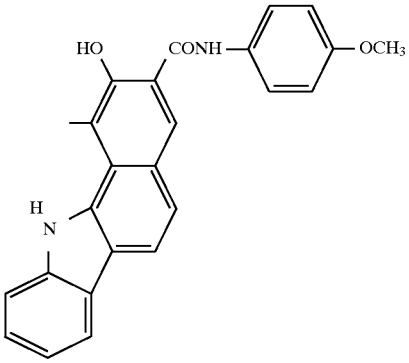
68
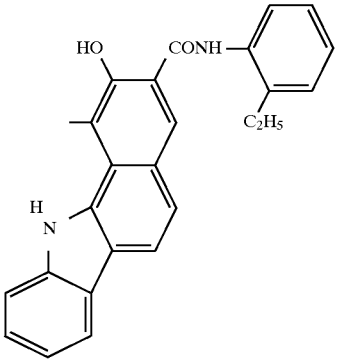

TABLE 4-5-continued
69
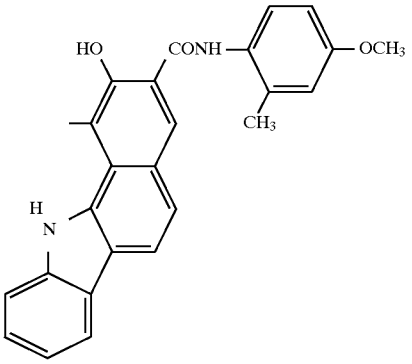
70
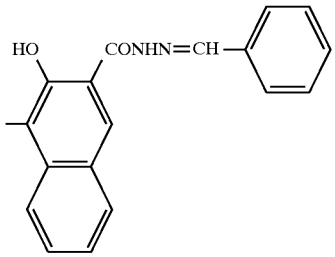
TABLE 4-6
71
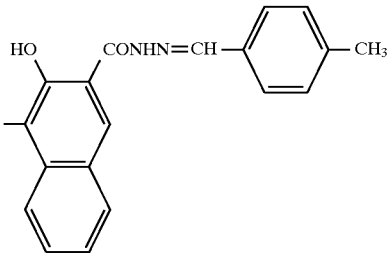
72
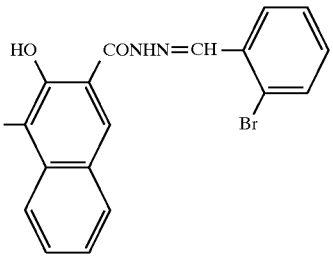
73
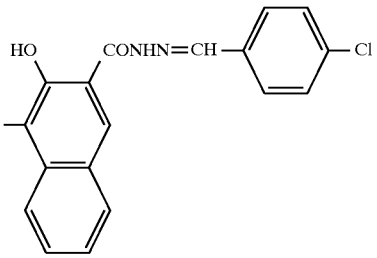
TABLE 4-6-continued
74
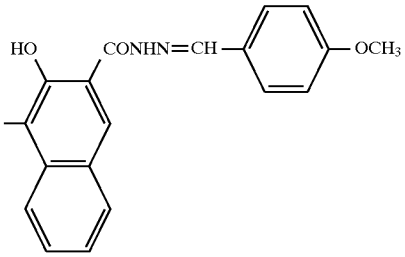
75
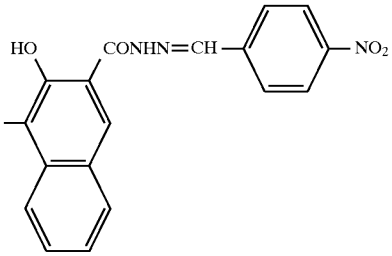
76
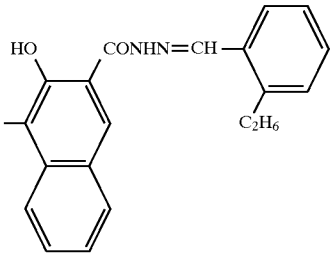
77
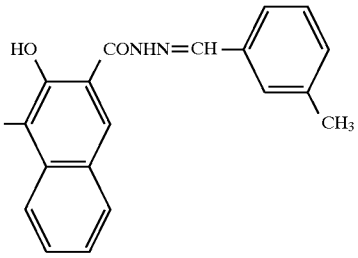
78
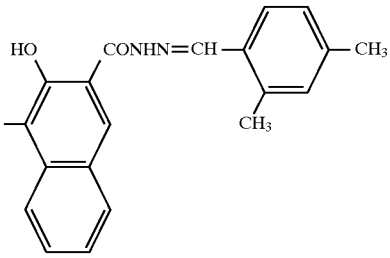

TABLE 4-6-continued
79
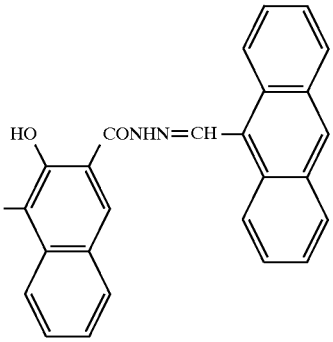
80
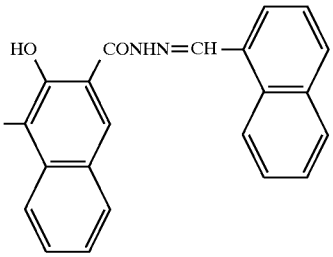
81
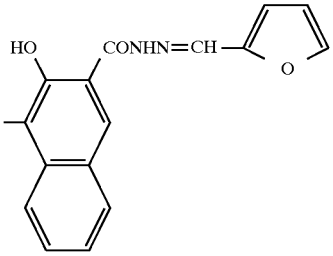
82
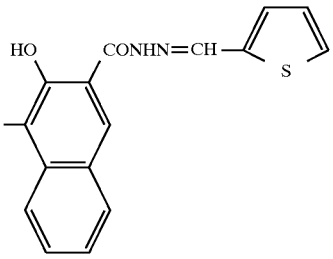
83
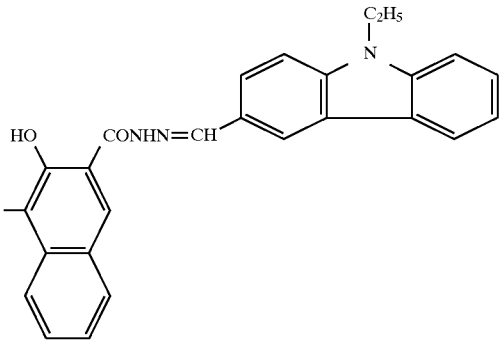
TABLE 4-6-continued
84
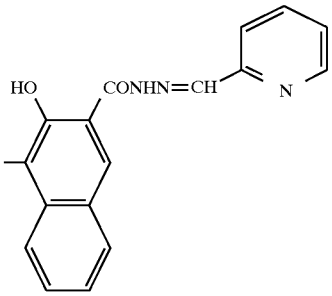
TABLE 4-7
85
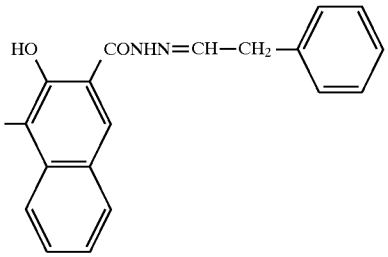
86
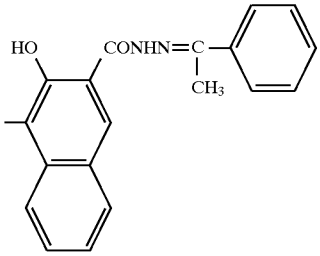
87
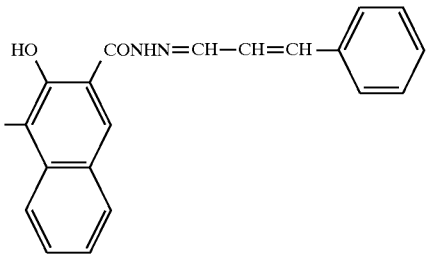
88
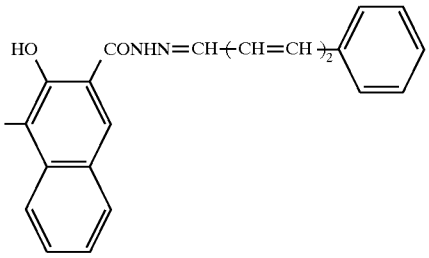

TABLE 4-7-continued
89
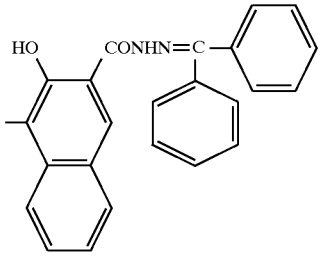
90
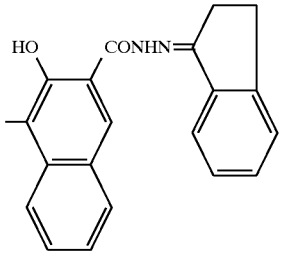
91
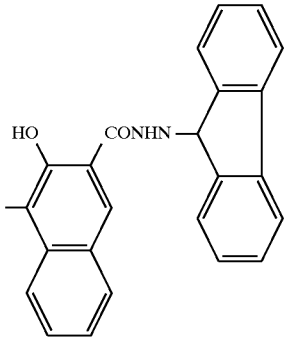
92
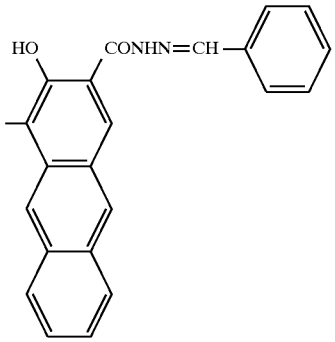
93
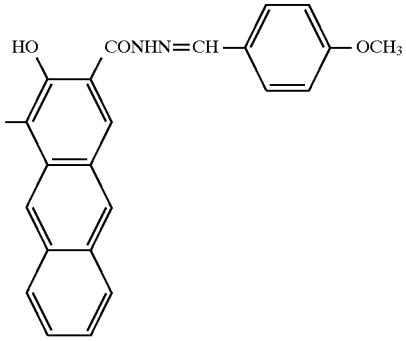
TABLE 4-7-continued
94
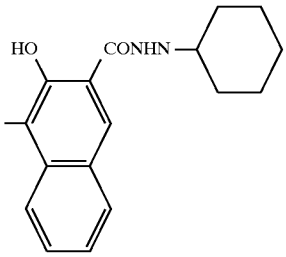
95
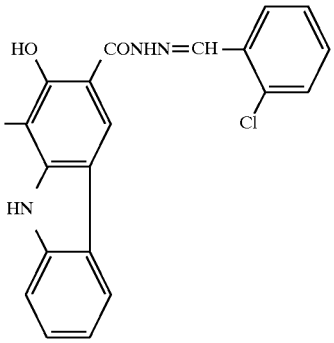
96
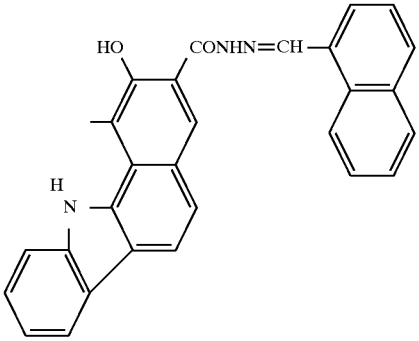
97
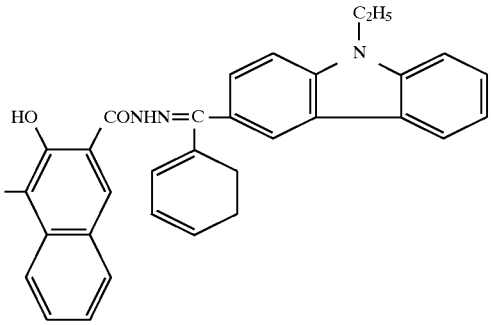
Further, a cyanine compound of the following formula (V) may be mentioned as another preferred coloring matter for the present invention.
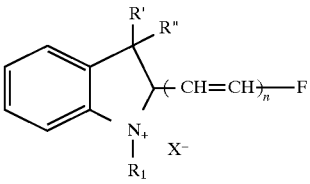
(V)
In the above formula, n is 0, 1 or 2, X is a halogen atom such as fluorine, chorine or bromine, $CH_3SO_4^-$ or $CH_3C_6H_4SO_4^-$, $R_1$ is a hydrogen atom, or a substituted or unsubstituted alkyl group having from 1 to 4 carbon atoms, for example, an alkyl group such as a methyl group, an ethyl group, a n-propyl group, an i-propyl group, a n-butyl group or a t-butyl group. Each of R' and R" is a substituted or unsubstituted alkyl group having from 1 to 3 carbon atoms, for example, an alkyl group such as a methyl group, an ethyl group, a n-propyl group or an i-propyl group. F is a residue of the following formula (G), (H) or (I).

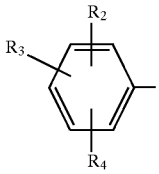

(G)

In the above formula, each of $R_2$, $R_3$ and $R_4$ is a hydrogen atom, a halogen atom such as fluorine, chlorine or bromine, a substituted or unsubstituted alkoxy group having from 1 to 4 carbon atoms, for example, an alkoxy group such as a methoxy group, an ethoxy group, a propoxy group or a butoxy group, a substituted or unsubstituted alkyl group having from 1 to 4 carbon atoms, for example, an alkyl group such as a methyl group, an ethyl group, a n-propyl group, an i-propyl group, a n-butyl group or a t-butyl group, or a substituted or unsubstituted amino group such as an alkylamino group, a dialkylamino group, an arylamino group, an alkylarylamino group or a diarylamino group.

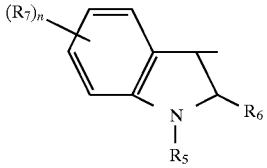

(H)

In the above formula, each of $R_5$ and $R_6$ is a hydrogen atom, or a substituted or unsubstituted alkyl group having from 1 to 4 carbon atoms, for example, an alkyl group such as a methyl group, an ethyl group, a n-propyl group, an i-propyl group, a n-butyl group or a t-butyl group, $R_7$ is a hydrogen atom, a halogen atom such as fluorine, chlorine or bromine, a substituted or unsubstituted alkoxy group having from 1 to 4 carbon atoms, for example, an alkoxy group such as a methoxy group, an ethoxy group, a propoxy group or a butoxy group, a substituted or unsubstituted alkyl group having from 1 to 4 carbon atoms, for example, an alkyl group such as a methyl group, an ethyl group, a n-propyl group, an i-propyl group, a n-butyl group or a t-butyl group, or a substituted or unsubstituted amino group such as an alkylamino group, a dialkylamino group, an arylamino group, an alkylarylamino group or a diarylamino group. n is integer of from 0 to 4.

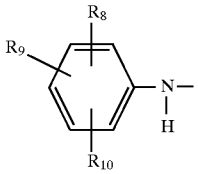

(I)

In the above formula, each of $R_8$, $R_9$ and $R_{10}$ is a hydrogen atom, a halogen atom such as fluorine, chlorine or bromine, a substituted or unsubstituted alkoxy group having from 1 to 4 carbon atoms, for example, an alkoxy group such as methoxy group, an ethoxy group, a propoxy group or a butoxy group, a substituted or unsubstituted alkyl group having from 1 to 4 carbon atoms, for example, an alkyl group such as a methyl group, an ethyl group, a n-propyl group, an i-propyl group, a n-butyl group or a t-butyl group, or a substituted or unsubstituted amino group such as an alkylamino group, a dialkylamino group, an arylamino group, an alkylarylamino group or a diarylamino group.

Some specific examples of the structural formula of F of the cyanine compound of the above formula (V) will be shown in the following Table 5. Of course, the present invention is not limited to such specific examples.

TABLE 5

| | |
|---|---|
| F-1 | 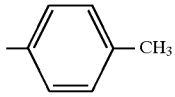 |
| F-2 | 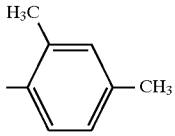 |
| F-3 | 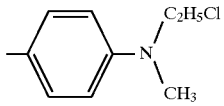 |
| F-4 | 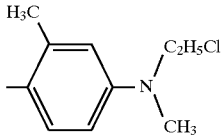 |
| F-5 | 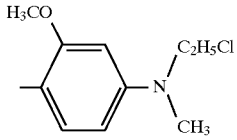 |
| F-6 | 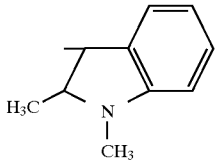 |
| F-7 | 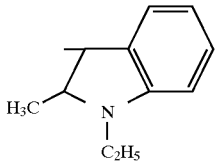 |
| F-8 | 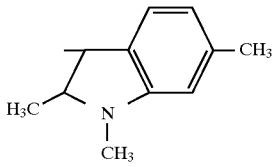 |
| F-9 | 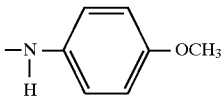 |

TABLE 5-continued

| | |
|---|---|
| F-10 | 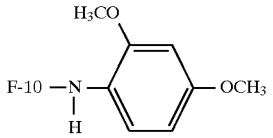 |

Further, a compound of the following formula (VI) may be mentioned as another preferred coloring matter for the present invention.

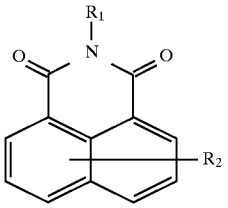

(VI)

In the above formula, each of $_1$ and $R_2$ is a hydrogen atom, a hydroxyl group, a substituted or unsubstituted alkyl group having from 1 to 4 carbon atoms, for example, an alkyl group such as a methyl group, an ethyl group, a n-propyl group, an i-propyl group, a n-butyl group or a t-butyl group, a substituted or unsubstituted alkoxy group having from 1 to 4 carbon atoms, for example, an alkoxy group such as a methoxy group, an ethoxy group, a propoxy group or a butoxy group, a substituted or unsubstituted aryl group such as a phenyl group, a diphenyl group or a naphthyl group, or a substituted or unsubstituted amino group such as an alkylamino group, a dialkylamino group, an arylamino group, an alkylarylamino group or a diarylamino group.

Some specific examples of the compound having the structure of the above formula (VI) will be shown in the following Table 6. Of course, the present invention is not limited to such specific examples.

TABLE 6

| | |
|---|---|
| 1 | 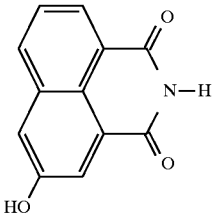 |
| 2 | 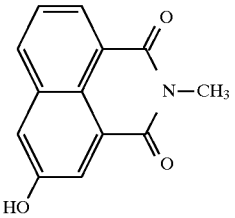 |

TABLE 6-continued

| | |
|---|---|
| 3 | 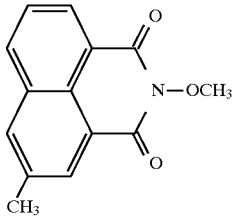 |
| 4 | 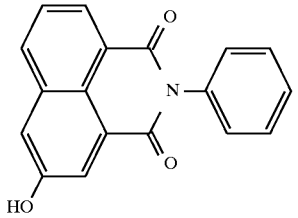 |
| 5 | 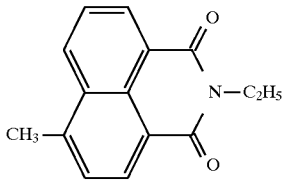 |
| 6 | 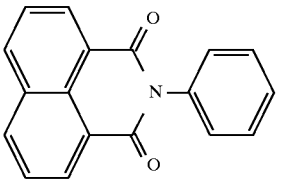 |
| 7 | 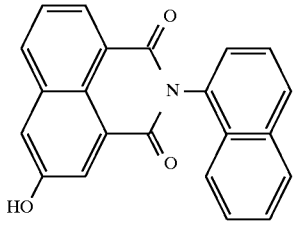 |
| 8 | 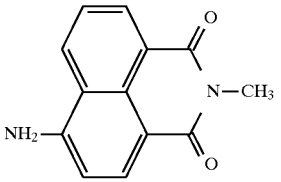 |
| 9 | 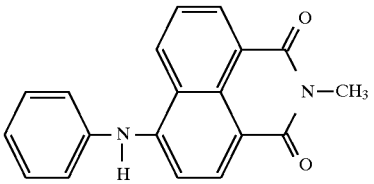 |

TABLE 6-continued

| | |
|---|---|
| 10 | 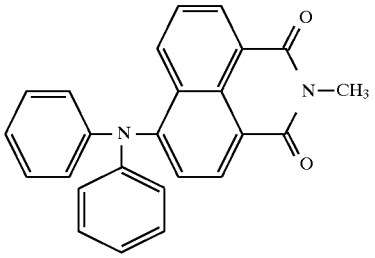 |
| 11 | 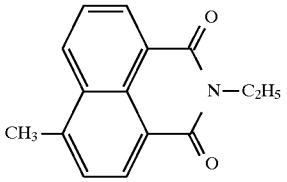 |
| 12 | 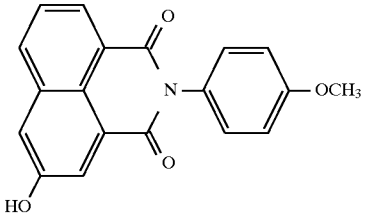 |
| 13 | 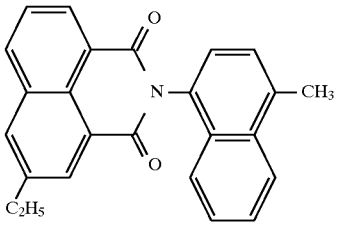 |

Now, it will be explained that the concept of the present invention is totally different from the prior art.

In the prior art, two or more carrier generation materials differing in the sensitivity are used in combination, and the sensitivity is adjusted to the desired level by changing the blend ratio thereof. In such a case, the level to which the sensitivity can be adjusted is usually inbetween the sensitivities of the respective carrier generation materials to be mixed. On the other hand, in many cases where the sensitivity is adjusted by mixing an extender such as a binder to the carrier generation material, the sensitivity may be adjusted, but other photosensitive properties such as the residual potential, dark decay, etc. tend to deteriorate.

Whereas, the photoreceptor of the present invention has a feature that the sensitivity can be adjusted easily within a wide range from a lower sensitivity to a high sensitivity without deteriorating other properties of the photoreceptor, by changing the blend ratio of the carrier generation material having a carrier generating ability in a near-infrared wavelength region and the coloring agent having no substantial sensitivity in a visible light region and a near-infrared wavelength region.

The mechanism for lowering the sensitivity only without impairing other properties may be assumed as follows. The reduction in the sensitivity is believed to be brought about by a combination of two effects of "carrier separation inhibition effect" and "extender effect" of the coloring matter to be added. Now, the respective effects will be described.

"Carrier separation inhibition effect": The carrier formation process by a carrier generation material is believed to be as shown in FIG. 1.

(1) Light absorption→(2) Excitation→(3) Formation of a carrier pair→(4) Separation of carriers →(5) Carrier injection Here, if the coloring matter of the present invention is incorporated, partial energy transfer to the coloring matter is believed to take place even at the stage of (2) excitation or (3) formation of a carrier pair, whereby the carrier generation material is believed to be deactivated. Accordingly, the number of carriers contributing to the sensitivity decreases, and consequently, the reduction of the sensitivity takes place.

"Extender effect": To mix a coloring matter having no carrier generation ability to a carrier generation material means to substitute the coloring matter for the carrier generation material i.e. to let the coloring matter function as an extender. Namely, the sensitivity is believed to decrease, because the content of the carrier generation material in the carrier generation layer decreases.

It is believed that by the above described mechanism, the sensitivity decreases. However, other physical or electrical properties of the coloring matter, such as the particle size, the surface activity, the dispersibility in the resin, the electroconductivity, etc. may also contribute to the reduction of the sensitivity of the present invention. Accordingly, with respect to the coloring matter to be mixed to the carrier generation material, there is no uniform means for selection. In the present invention, the combination of the carrier generation material having a sensitivity in a near-infrared wavelength region with the coloring matter of the present invention, has been determined by a number of experiments among numerous inorganic and organic compounds.

With the photoreceptor of the present invention, it is possible to adjust the sensitivity of an electrophotographic photoreceptor to the sensitivity required by the light source for exposure to be used here to obtain a sharp image in an image-forming process comprising a step of forming an electrostatic latent image by spot exposure by means of an exposure beam and a step of developing the electrostatic latent image with a developer.

Now, as a method for preparing a coating liquid for coating a photosensitive layer, such a carrier generation material and a coloring matter are mixed and dispersed in a dispersing medium, and finally adjusted as a coating liquid for coating the photosensitive layer in a state as mixed with a binder resin, or the carrier generation material and the coloring matter are dispersed in the respective dispersing media and further adjusted in a state as mixed with a binder resin, and the separately prepared liquids are then mixed to obtain a coating liquid for coating the photosensitive layer.

As the dispersing medium, various solvents may be employed. For example, ethers such as diethyl ether, dimethoxymethane, tetrahydrofuran and 1,2-dimethoxyethane; ketones such as acetone and methyl ethyl ketone; esters such as methyl acetate and ethyl acetate; and alcohols such as methanol, ethanol and propanol, may be used alone or in combination as a mixture of two or more of them.

As the binder resin, vinyl polymers such as polyvinyl butyral, polyvinyl acetal, polyester, polycarbonate, polystyrene, polyester carbonate, polysulfone, polyimide, polymethyl methacrylate and polyvinyl chloride, and their copolymers, phenoxy, epoxy and silicone resins and their partially crosslinked cured products may be employed alone or in combination as a mixture of two or more of them.

As a method for dispersing the carrier generation material and the coloring matter, a known method such as a method by means of a ball mill, a sand grind mill, a planetary mill or a roll mill, may be employed. As a method for mixing the binder resin with carrier generation material particles or coloring matter particles, a method of dispersing the binder resin in a state of a powder or in the form of its polymer solution during the dispersing treatment of the carrier generation material particles or coloring matter particles for simultaneous dispersion, a method of mixing the dispersion into a polymer solution of the binder resin, or a method of mixing such a polymer solution to the dispersion, may be employed.

With respect to the proportions of the carrier generation material and the coloring matter, the coloring matter is used within a range of from 0.01 to 10 parts by weight per part by weight of the carrier generation material. In a case where the carrier generation material and the coloring matter are respectively dispersed in separate dispersing media and separately mixed with binder resins, and the separately prepared liquids are then mixed to obtain a coating liquid for coating a photosensitive layer, the separately prepared liquids may be mixed by a method of mixing by means of a mechanical stirrer, a homomixer or a homogenizer, a method of mixing by applying supersonic waves, or any other known method.

Then, the dispersion thus obtained may be diluted with any solvent to let it have liquid properties suitable for coating. As such a solvent, those solvents exemplified above as the dispersing media may, for example, be employed. With respect to the ratio of the carrier generation material and the coloring matter to the binder resin, there is no particular limitation, but it is usual that the carrier generation material and the coloring matter are used in a total amount within a range of from 5 to 500 parts by weight per 100 parts by weight of the resin. Further, in this dispersion, the concentration of the carrier generation material and the coloring matter is preferably within a range of from 0.1 to 10 wt %.

Further, a carrier transport material may be incorporated, as the case requires. As such a carrier transport material, an electron attractive substance such as 2,4,7-trinitrofluorenone or tetracyanoxydimethane, or an electron donative substance, such as a heterocyclic compound such as carbazole, indole, imidazole, oxazole, oxadiazole, pyrazoline or thiazole, an aniline derivative, a hydrazone derivative, an aromatic amine derivative, a stilbene derivative or a polymer having groups of such a compound on its main chain or side chain, may, for example, be mentioned. With respect to the proportions of the carrier transport material and the binder resin, the carrier transport material is used within a range of from 5 to 500 parts by weight per 100 parts by weight of the binder resin.

Using the dispersion thus prepared, a carrier generation layer is formed on an electroconductive substrate, and a carrier transport layer is laminated thereon to form a photosensitive layer. Otherwise, a carrier transport layer is formed on an electroconductive substrate, and a carrier generation layer is formed thereon by means of the above-mentioned dispersion to form a photosensitive layer. Or, a photosensitive layer may be formed by applying the dispersion containing a carrier transport material on an electroconductive substrate. Any one of these methods may be employed for the formation of a photosensitive layer. However, to obtain the effects of the present invention, it is necessary that the carrier generation material and the coloring matter are contained in the same carrier generation layer.

In a case where a photosensitive layer is formed by lamination of a carrier transport layer, the thickness of the carrier generation layer is preferably within a range of from 0.1 $\mu$m to 10 $\mu$m, and the thickness of the carrier transport layer is preferably from 5 to 60 $\mu$m. In a case where a photosensitive layer is formed to have a single layer structure of the carrier generation layer, the thickness of the carrier generation layer is preferably within a range of from 5 to 60 $\mu$m.

In a case where the carrier transport layer is provided, the carrier transport material to be used, may be a material exemplified as the carrier transport material. If necessary, a binder resin may be blended together with such a carrier transport material. As such a binder resin, the one exemplified above as the binder resin may be employed. For the photosensitive layer, various known additives may be incorporated, as the case requires. Such additives may, for example, be an antioxidant, a radical-capturing agent, a deterioration-preventing agent such as an ultraviolet absorber, a softening agent, a plasticizer, a surface-improving agent, a thickener, an extender, a dispersion-stabilizer, a leveling agent, wax, an acceptor and a donor.

Further, in order to protect such a photosensitive layer from external impact, a film protective layer may be provided on the surface of the photosensitive layer.

The electroconductive substrate on which the photosensitive layer is formed, may, for example, be a metal material such as aluminum, stainless steel or nickel, or an insulating substrate such as polyester film, paper or glass provided on its surface with a conductive layer of e.g. aluminum, copper, palladium, tin oxide or indium oxide. A known barrier layer which is commonly used, may be provided between the electroconductive substrate and the photosensitive layer.

The barrier layer may, for example, be an inorganic layer of e.g. anodized aluminum, aluminum oxide or aluminum hydroxide, an organic layer of e.g. polyvinyl alcohol, casein, polyvinyl pyrrolidone, polyacrylic acid, cellulose, gelatin, starch, polyurethane, polyimide or polyamide, or an organic-inorganic composite layer having conductive particles such as aluminum oxide or titanium oxide particles dispersed in the above organic layer. The thickness of the barrier layer is preferably within a range of from 0.1 to 20 $\mu$m, most effectively within a range of from 0.1 to 10 $\mu$m.

As a coating method for such a photosensitive layer, a protective layer and a barrier layer, a conventional method such as a dipping method, a spray coating method, a spinner coating method or a blade coating method may be employed.

Now, the present invention will be described in further detail with reference to Examples. However, it should be understood that the present invention is by no means restricted to such specific Examples.

EXAMPLE 1

Figure 3:
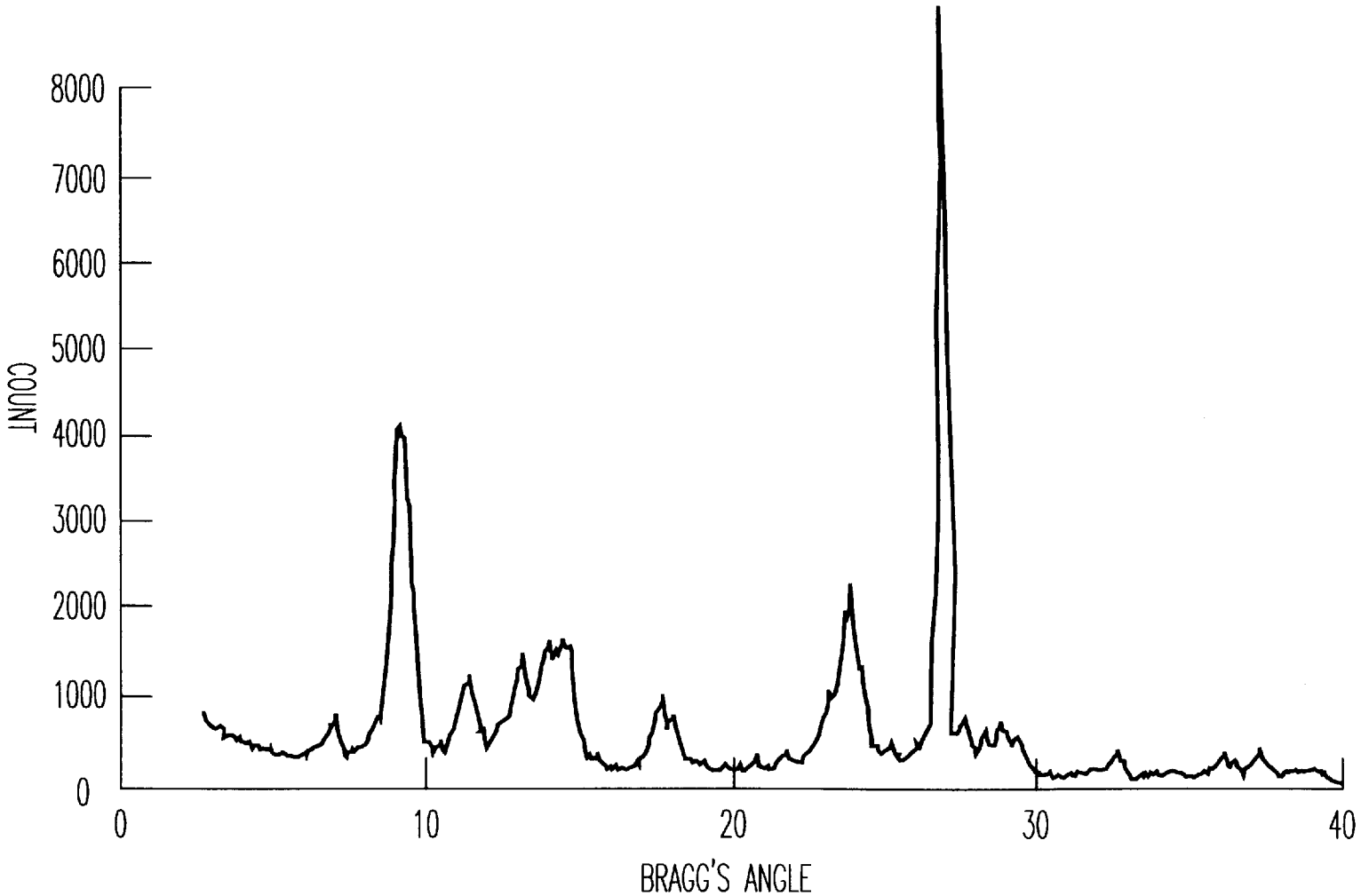
FIG. 3 is an X-ray diffraction spectrum by CuKα ray of oxytitanium phthalocyanine used in Example 1.
Figure 5:
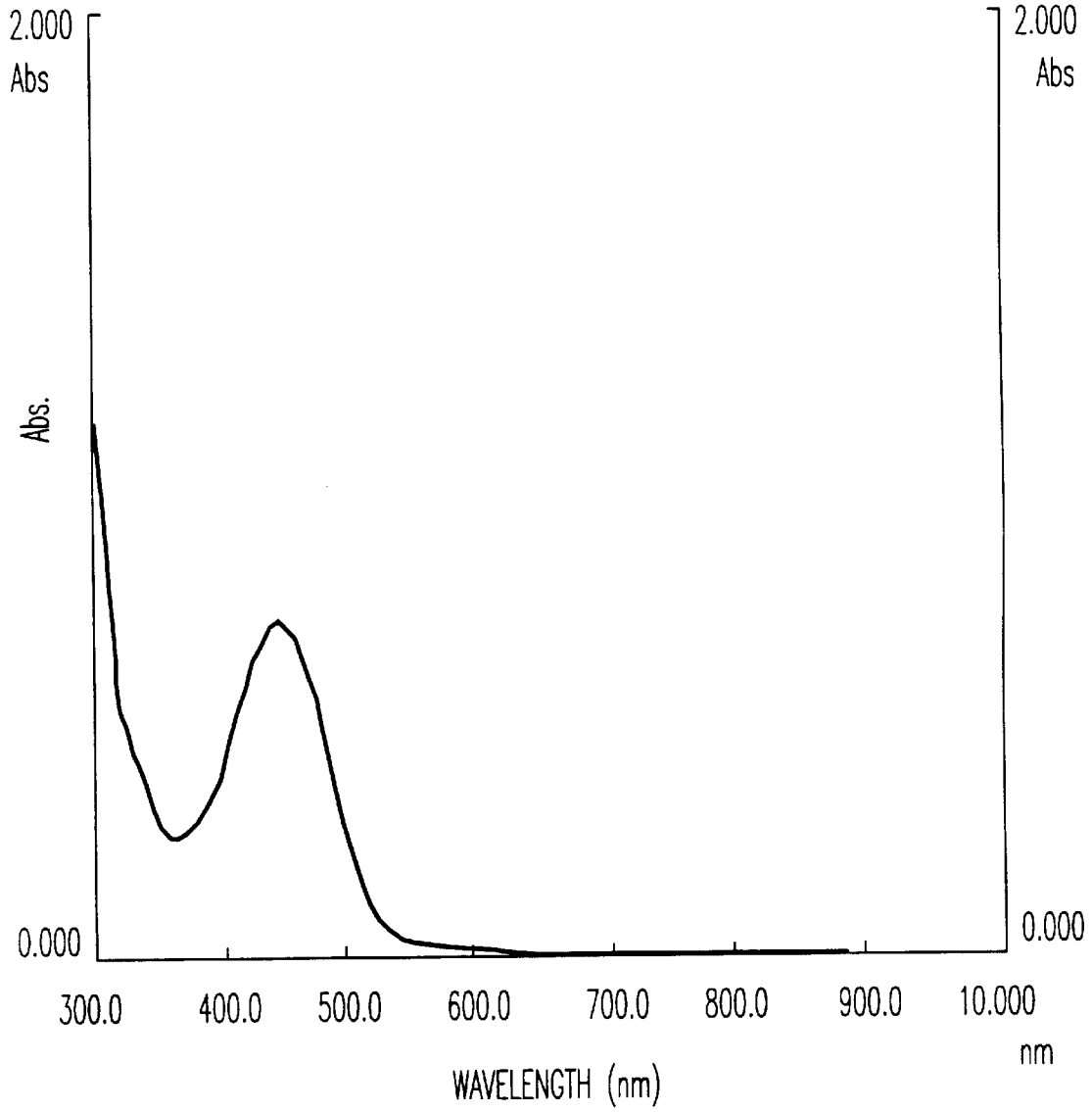
FIG. 5 is a visible light and infra-red light absorption spectrum of anthraquinone compound No. 1 used in Example 1.
Figure 8:
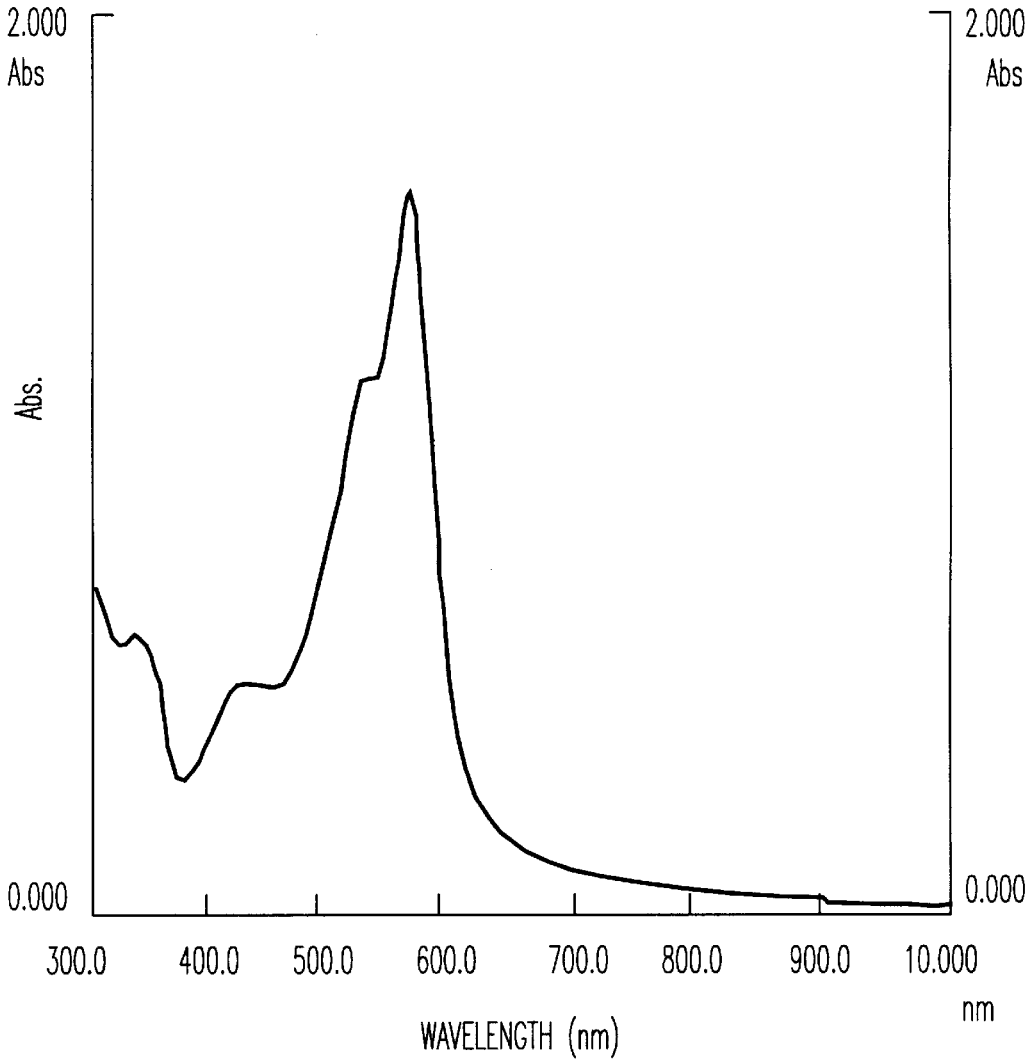
FIG. 8 is a visible light and infra-red light absorption spectrum of azolake compound No. 1 used in Example 9.

200 parts by weight of n-propanopl was added to 2 parts by weight of D-form oxytitanium phthalocyanine having an X-ray diffraction spectrum by CuK$\alpha$-ray as shown in FIG. 3 and 8 parts by weight of anthraquinone compound No. 1 as shown in Table 1, followed by pulverization and dispersion treatment for 10 hours by a sand grind mill. Here, a visible light absorption spectrum of anthraquinone compound No. 1 is shown in FIG. 5. From this spectrum, Abs (700 nm)/Abs ($\lambda$max) was calculated to be 0. Then, a 10% methanol solution of 5 parts by weight of polyvinyl butyral (Denka Butyral #6000C, tradename, manufactured by Denki Kagaku Kogyo K.K.) was mixed therewith to obtain a dispersion. Then, this dispersion was coated by a bar coater on an aluminum vapor deposited surface of a polyester film so that the coated film thickness after drying would be 0.4 $\mu$m, to form a carrier generation layer. Then, on this carrier generation layer, a liquid prepared by dissolving 56 parts by weight of the following hydrazone compound:

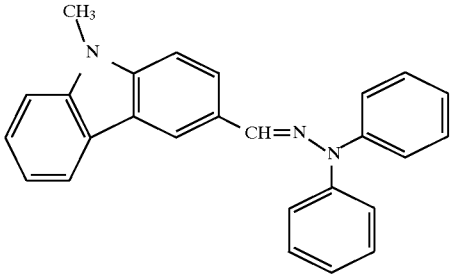

14 parts by weight of the following hydrazone compound:

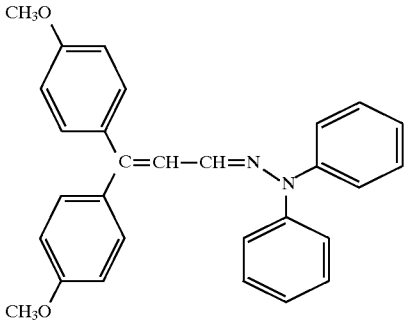

1.5 parts by weight of the following cyano compound:

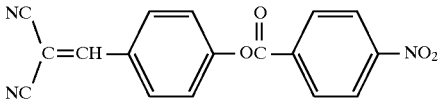

and 100 parts by weight of a polycarbonate resin (Novalex 7030A, tradename, manufactured by Mitsubishi Chemical Corporation) in 1,000 parts by weight of 1,4-dioxane, was coated by a film applicator, so that the film thickness after drying would be 17 $\mu$m, to form a carrier transport layer. The photoreceptor thus obtained was designated as photoreceptor A.

EXAMPLE 2

A photoreceptor was prepared in the same manner as in Example 1 except that 5 parts by weight of oxytitanium phthalocyanine and 5 parts by weight of anthraquinone compound No. 1 were used instead of the mixing ratio of the oxytitanium phthalocyanine and anthraquinone compound No. 1 used in Example 1. The photoreceptor thus obtained was designated as photoreceptor B.

EXAMPLE 3

Figure 6:
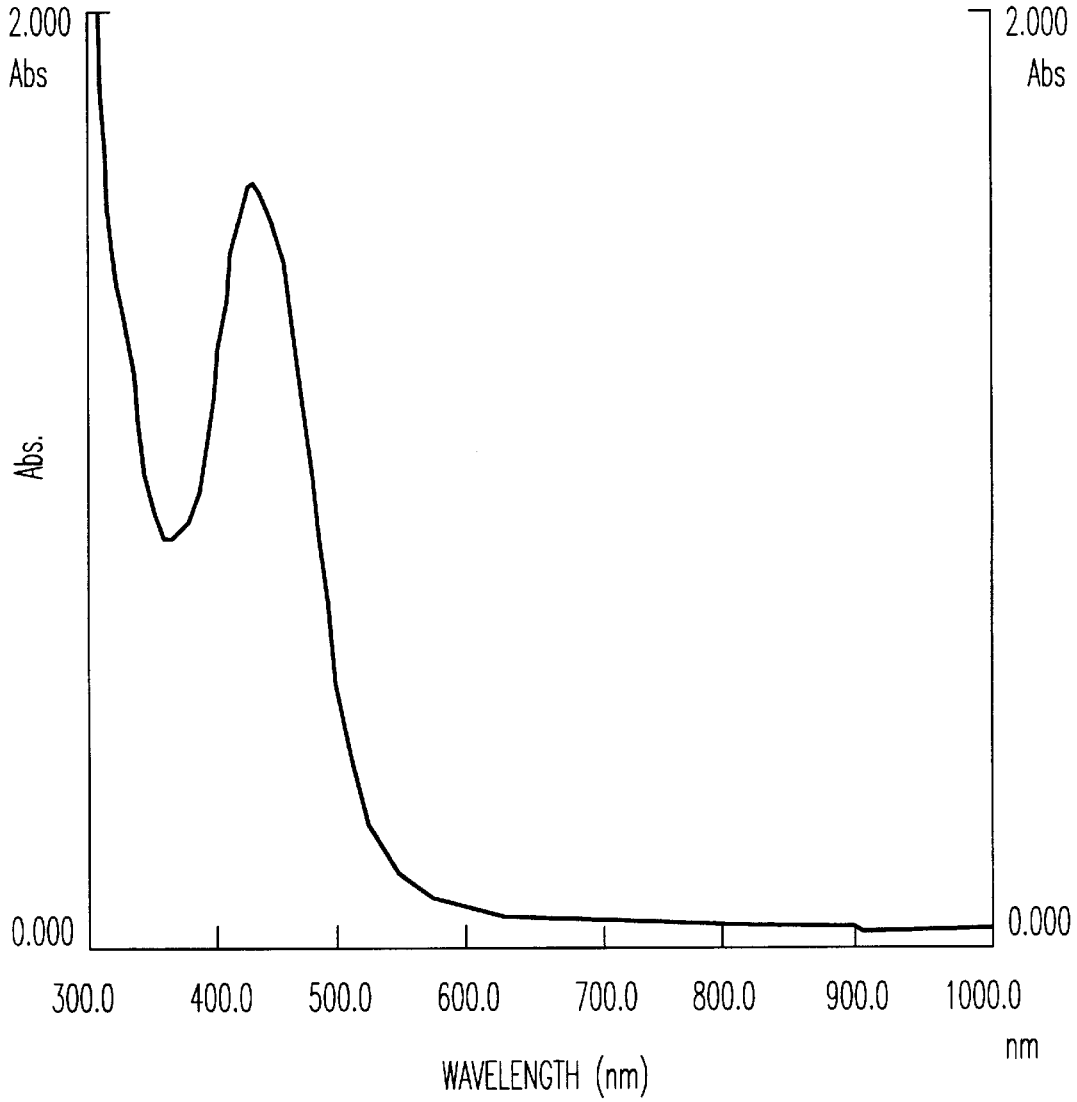
FIG. 6 is a visible light and infra-red light absorption spectrum of anthraquinone compound No. 3 used in Example 3.
Figure 7:
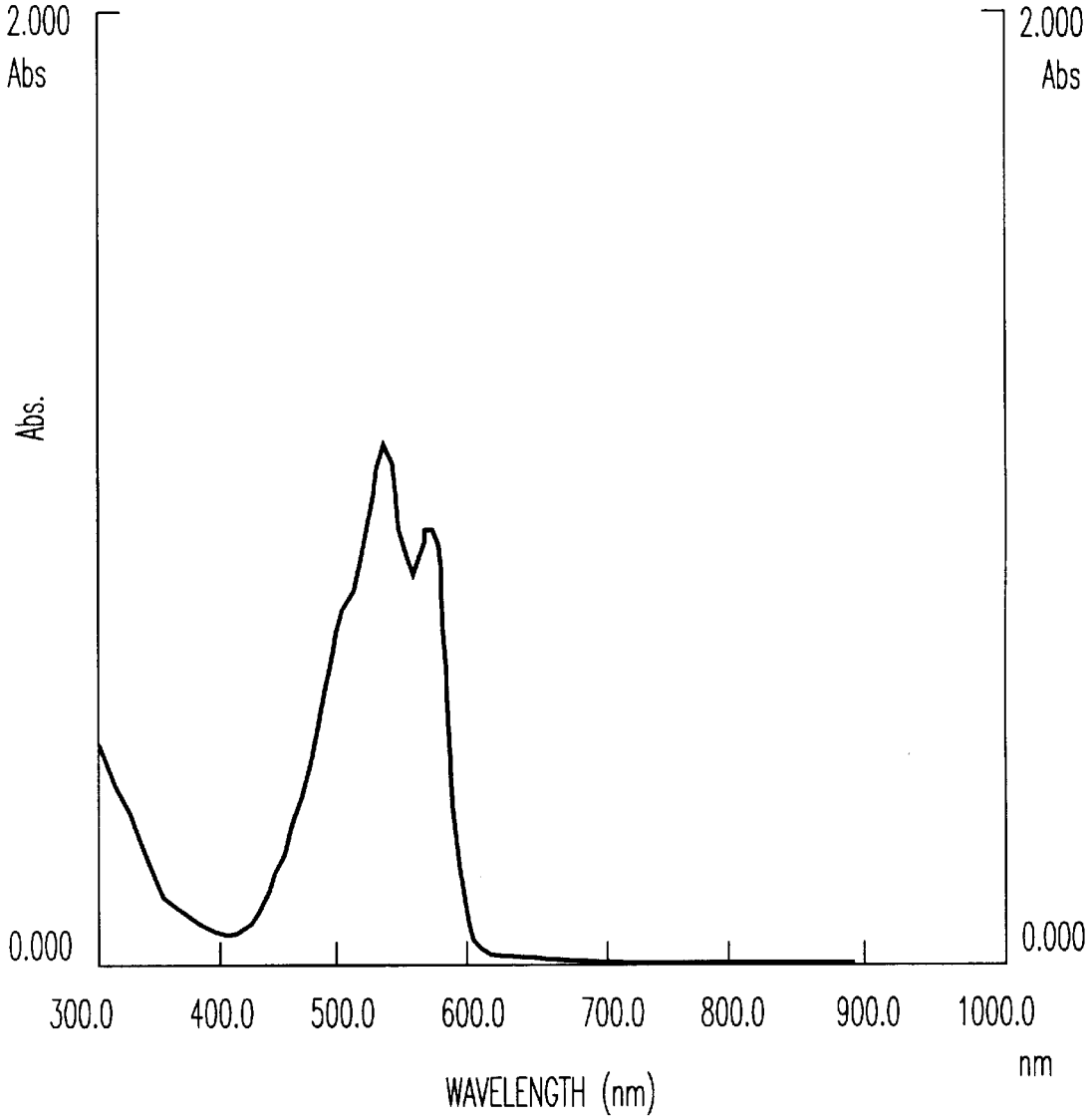
FIG. 7 is a visible light and infra-red light absorption spectrum of anthraquinone compound No. 12 used in Example 5.

A photoreceptor was prepared in the same manner as in Example 1 except that anthraquinone compound No. 1 used in Example 1 was changed to anthraquinone compound No. 3 as identified in Table 1. The photoreceptor thus obtained was designated as photoreceptor C. Here, a visible light absorption spectrum of anthraquinone compound No. 3 is shown in FIG. 6. From this spectrum, Abs (700 nm)/Abs ($\lambda$max) was calculated to be 0.03.

EXAMPLE 4

A photoreceptor was prepared in the same manner as in Example 2 except that anthraquinone compound No. 1 used in Example 2 was changed to anthraquinone compound No. 3 as identified in Table 1. The photoreceptor thus obtained was designated as photoreceptor D.

EXAMPLE 5

A photoreceptor was prepared in the same manner as in Example 1 except that anthraquinone compound No. 1 used in Example 1 was changed to anthraquinone compound No. 12 as identified in Table 1. The photoreceptor thus obtained was designated as photoreceptor E. Here, a visible light absorption spectrum of anthraquinone compound No. 12 is shown in Table 7. From this spectrum, Abs (700 nm)/Abs ($\lambda$max) was calculated to be 0.01.

EXAMPLE 6

A photoreceptor was prepared in the same manner as in Example 2 except that anthraquinone compound No. 1 used in Example 2 was changed to anthraquinone compound No. 12 as identified in Table 1. The photoreceptor thus obtained was designated as photoreceptor F.

EXAMPLE 7

Figure 4:
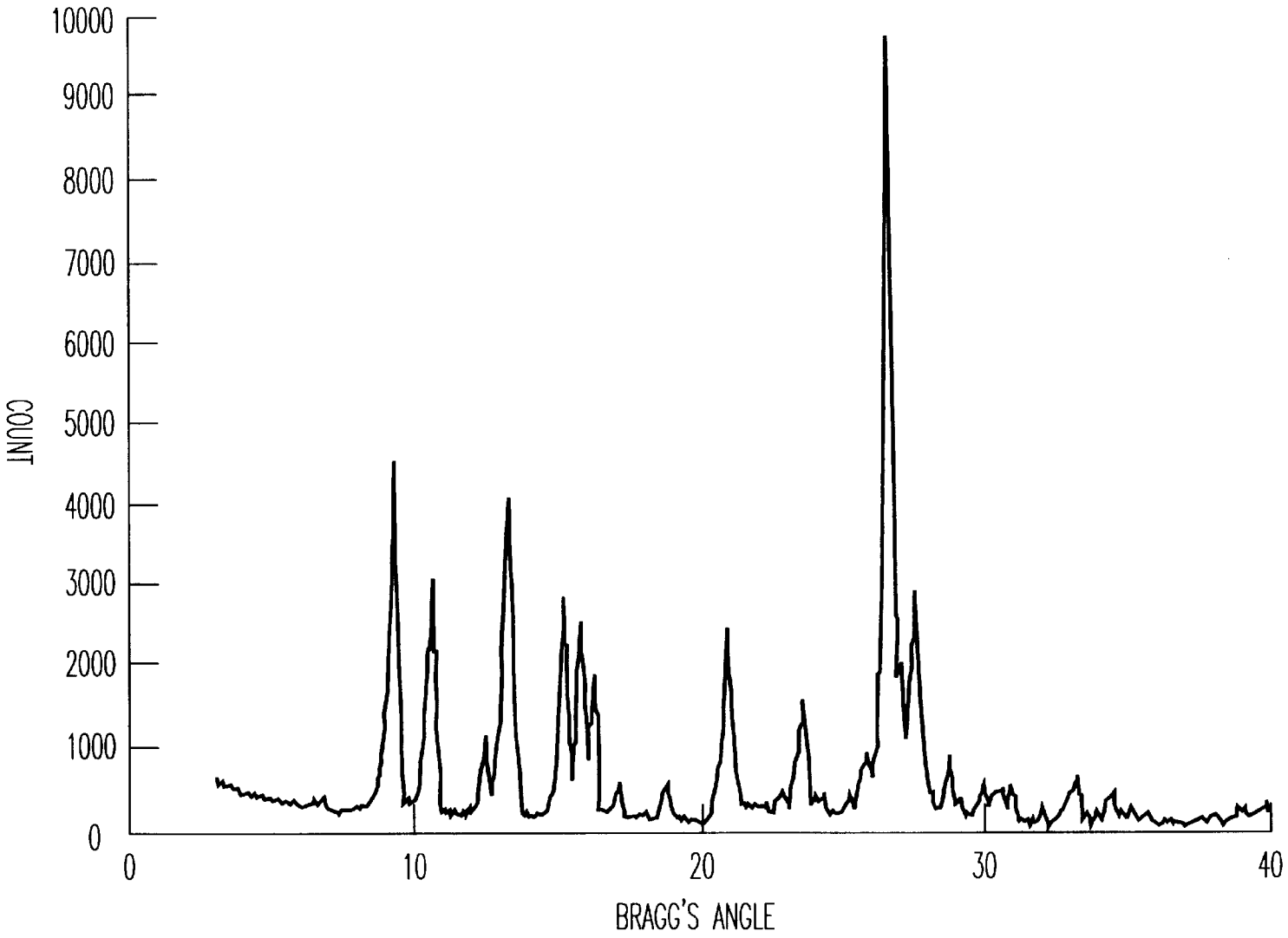
FIG. 4 is an X-ray diffraction spectrum by CuKα ray of oxytitanium phthalocyanine used in Example 7.

A photoreceptor was prepared in the same manner as in Example 1 except that instead of oxytitanium phthalocyanine used in Example 1, 9 parts by weight of $\beta$-form oxytitanium phthalocyanine having an X-ray diffraction spectrum by CuK$\alpha$-ray as shown in FIG. 4, and 1 part by weight of anthraquinone compound No. 1 as identified in Table 1 were used. The photoreceptor thus obtained was designated as photoreceptor G.

EXAMPLE 8

A photoreceptor was prepared in the same manner as in Example 7 except that 8 parts by weight of oxytitanium phthalocyanine and 2 parts by weight of anthraquinone compound No. 1 were used instead of the mixing ratio of the oxytitanium phthalocyanine and anthraquinone compound No. 1 used in Example 7. The photoreceptor thus obtained was designated as photoreceptor H.

EXAMPLE 9

A photoreceptor was prepared in the same manner as in Example 1 except that anthraquinone compound No. 1 used in Example 1 was changed to azolake compound No. 1 as identified in Table 2. The photoreceptor thus obtained was designated as photoreceptor I. Here, a visible light absorption spectrum of azolake compound No. 1 is shown in FIG. 8. From this spectrum, Abs (700 nm)/Abs ($\lambda$max) was calculated to be 0.05.

EXAMPLE 10

A photoreceptor was prepared in the same manner as in Example 2 except that anthraquinone compound No. 1 used in Example 2 was changed to azolake compound No. 1 as identified in Table 2. The photoreceptor thus obtained was designated as photoreceptor J.

EXAMPLE 11

Figure 9:
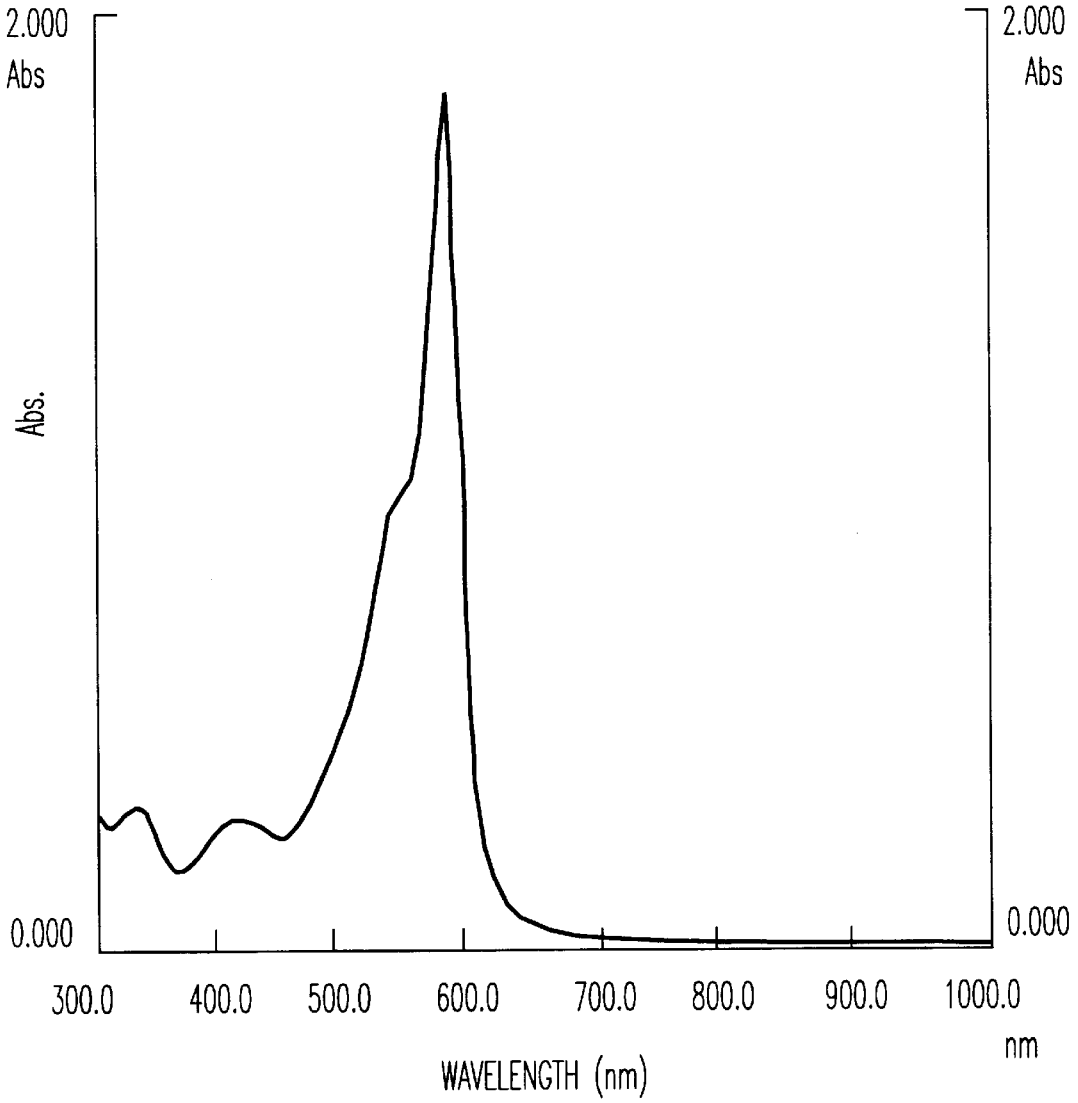
FIG. 9 is a visible light and infra-red light absorption spectrum of azolake compound No. 2 used in Example 11.

A photoreceptor was prepared in the same manner as in Example 1 except that anthraquinone compound No. 1 used in Example 1 was changed to azolake compound No. 2 as identified in Table 2. The photoreceptor thus obtained was designated as photoreceptor K. Here, a visible light absorption spectrum of azolake compound No. 2 is shown in FIG. 9. From this spectrum, Abs (700 nm)/Abs ($\lambda$max) was calculated to be 0.02.

EXAMPLE 12

A photoreceptor was prepared in the same manner as in Example 2 except that anthraquinone compound No. 1 used in Example 2 was changed to azolake compound No. 2 as identified in Table 2. The photoreceptor thus obtained was designated as photoreceptor L.

EXAMPLE 13

Figure 10:
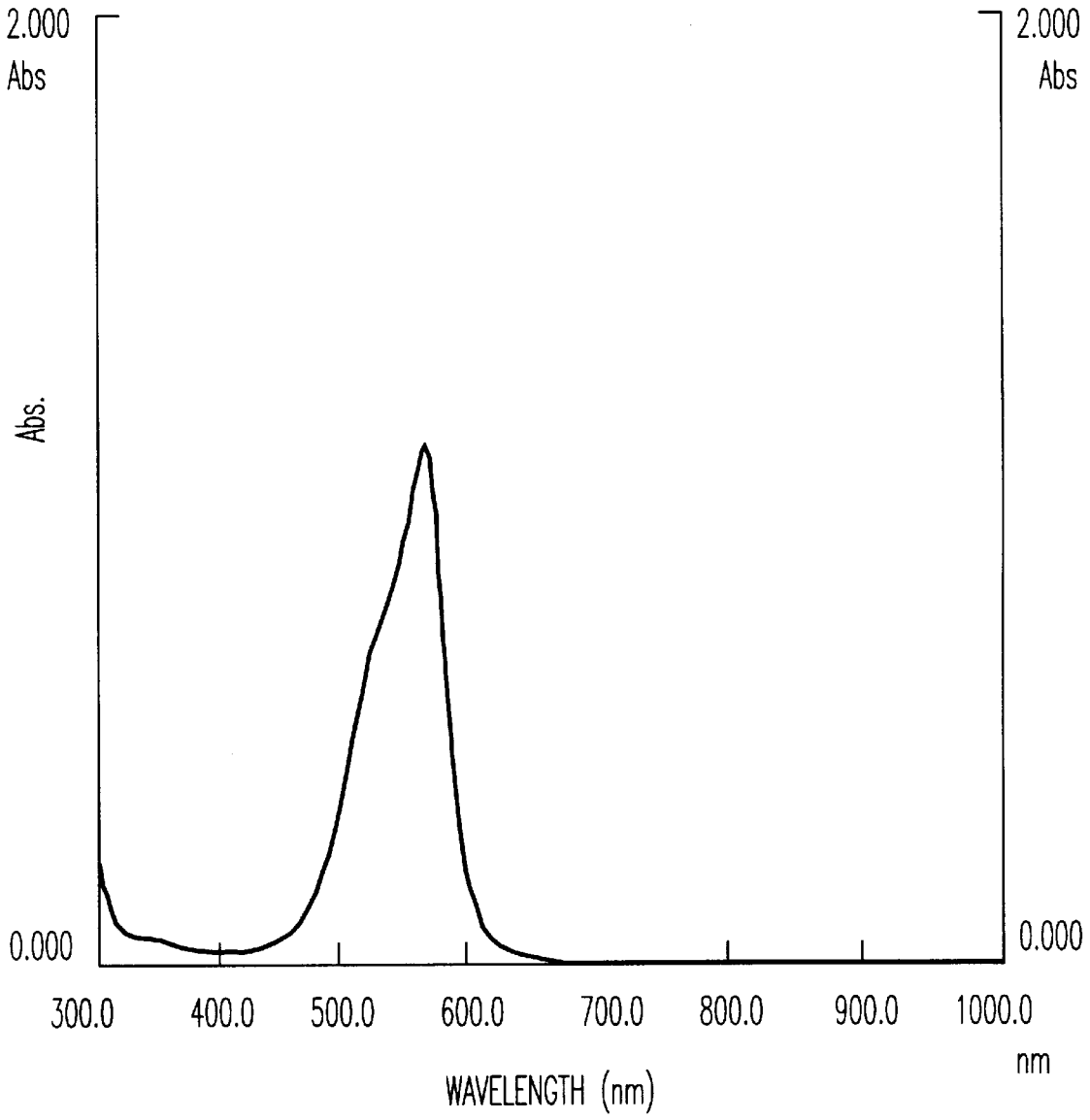
FIG. 10 is a visible light and infra-red light absorption spectrum of triaryl methane compound No. 1 used in Example 13.

A photoreceptor was prepared in the same manner as in Example 1 except that anthraquinone compound No. 1 used in Example 1 was changed to triarylmethane compound No. 1 as identified in Table 3. The photoreceptor thus obtained was designated as photoreceptor M. Here, a visible light absorption spectrum of triarylmethane compound No. 1 is shown in FIG. 10. From this spectrum, Abs (700 nm)/Abs (λmax) was calculated to be 0.

EXAMPLE 14

A photoreceptor was prepared in the same manner as in Example 2 except that anthraquinone compound No. 1 used in Example 2 was changed to triarylmethane compound No. 1 as identified in Table 3. The photoreceptor thus obtained was designated as photoreceptor N.

EXAMPLE 15

Figure 11:
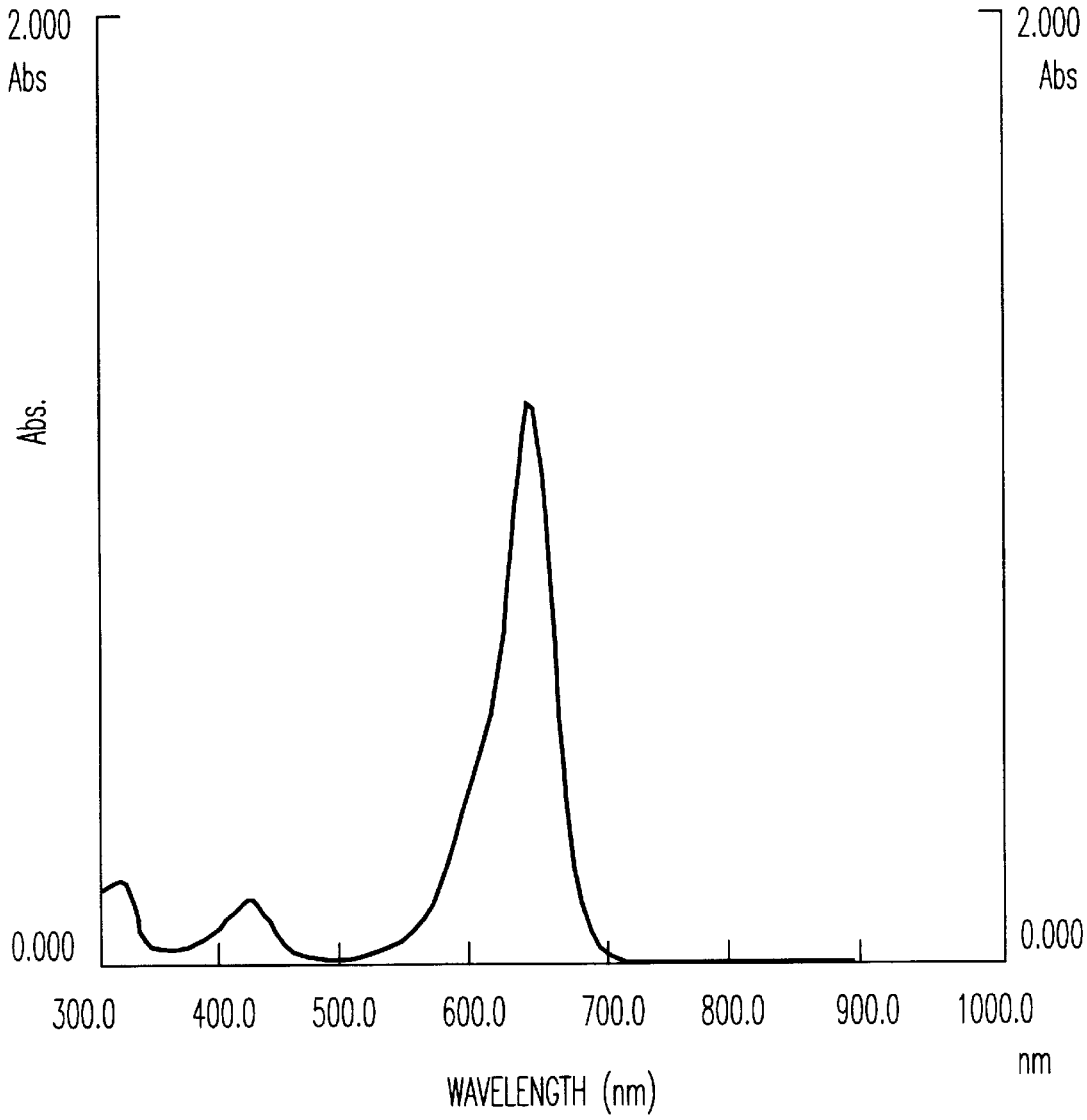
FIG. 11 is a visible light and infra-red light absorption spectrum of triaryl methane compound No. 2 used in Example 15.

A photoreceptor was prepared in the same manner as in Example 1 except that anthraquinone compound No. 1 used in Example 1 was changed to triarylmethane compound No. 2 as identified in Table 3. The photoreceptor thus obtained was designated as photoreceptor 0. Here, a visible light absorption spectrum of triarylmethane compound No. 2 is shown in FIG. 11. From this spectrum, Abs (700 nm)/Abs (λmax) was calculated to be 0.02.

EXAMPLE 16

A photoreceptor was prepared in the same manner as in Example 2 except that anthraquinone compound No. 1 used in Example 2 was changed to triarylmethane compound No. 2 as identified in Table 3. The photoreceptor thus obtained was designated as photoreceptor P.

EXAMPLE 17

Figure 12:
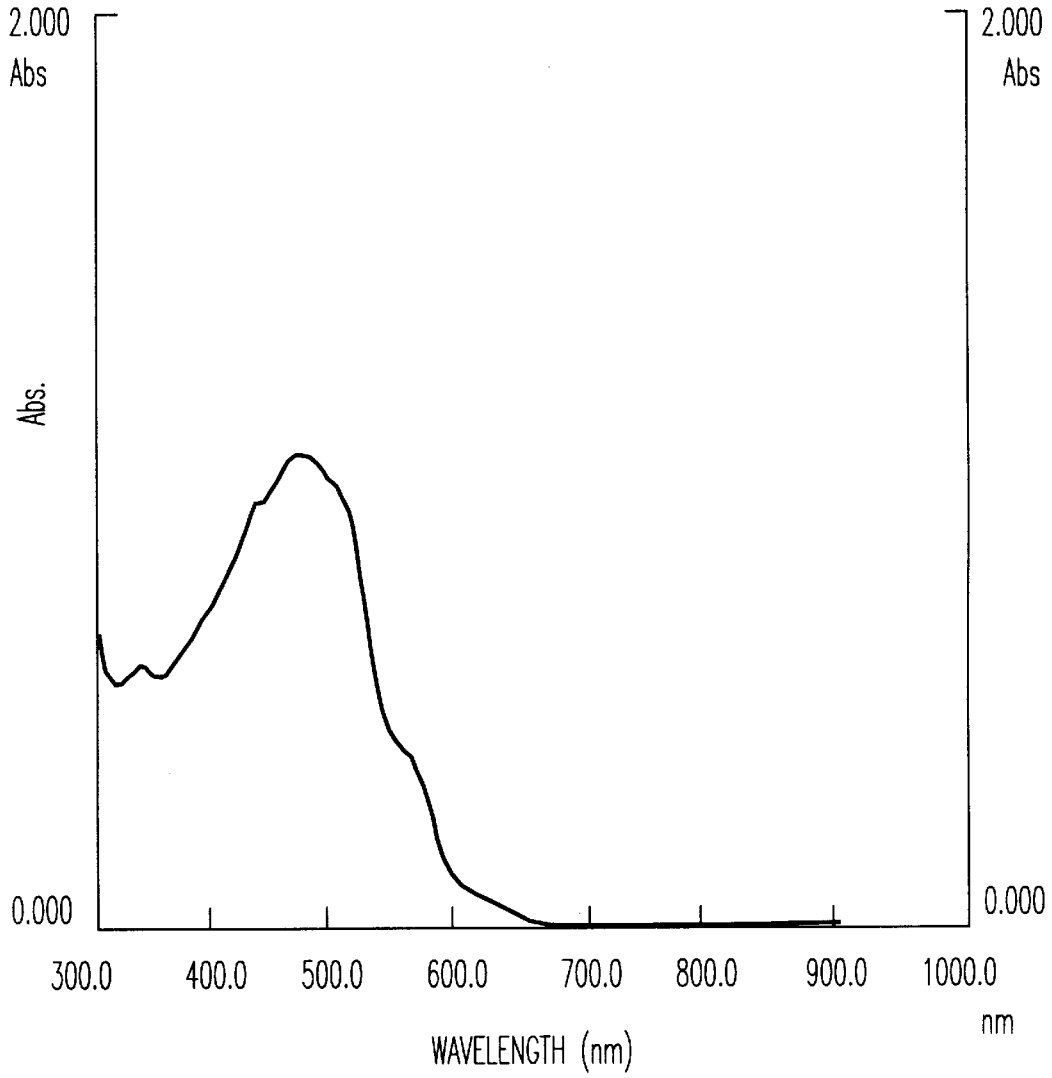
FIG. 12 is a visible light and near-infrared light absorption spectrum of the azo compound used in Example 17.

A photoreceptor was prepared in the same manner as in Example 1 except that anthraquinone compound No. 1 used in Example 1 was changed to an azo compound of the formula (IV) wherein D and E have structures of No. 2 and No. 15 as identified in Table 4. The photoreceptor thus obtained was designated as photoreceptor Q. Here, a visible light absorption spectrum of the azo compound is shown in FIG. 12. From this spectrum, Abs (700 nm)/Abs (λmax) was calculated to be 0.01.

EXAMPLE 18

A photoreceptor was prepared in the same manner as in Example 2 except that anthraquinone compound No. 1 used in Example 2 was changed to an azo compound of the formula (IV) wherein D and E have structures of No. 2 and No. 15 as identified in Table 4. The photoreceptor thus obtained was designated as photoreceptor R.

EXAMPLE 19

Figure 13:
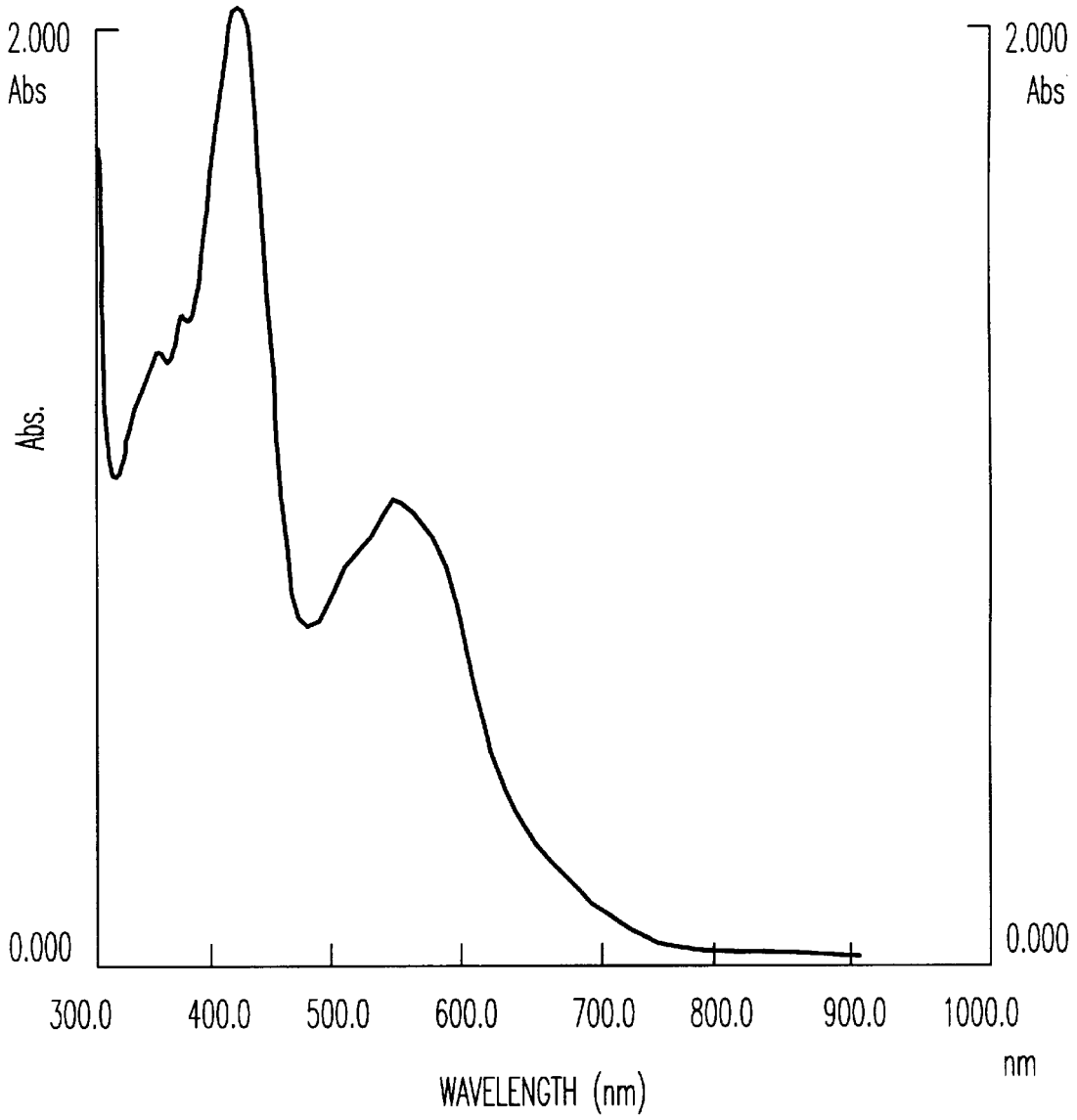
FIG. 13 is a visible light and near-infrared light absorption spectrum of the azo compound used in Example 19.

A photoreceptor was prepared in the same manner as in Example 1 except that anthraquinone compound No. 1 used in Example 1 was changed to an azo compound of the formula (IV) wherein D and E have structures of No. 1 and No. 27 as identified in Table 4. The photoreceptor thus obtained was designated as photoreceptor S. Here, a visible light absorption spectrum of the azo compound is shown in FIG. 13. From this spectrum, Abs (700 nm)/Abs (λmax) was calculated to be 0.04.

EXAMPLE 20

A photoreceptor was prepared in the same manner as in Example 2 except that anthraquinone compound No. 1 used in Example 2 was changed to an azo compound of the formula (IV) wherein D and E have structures of No. 1 and No. 27 as identified in Table 4. The photoreceptor thus obtained was designated as photoreceptor T.

EXAMPLE 21

Figure 14:
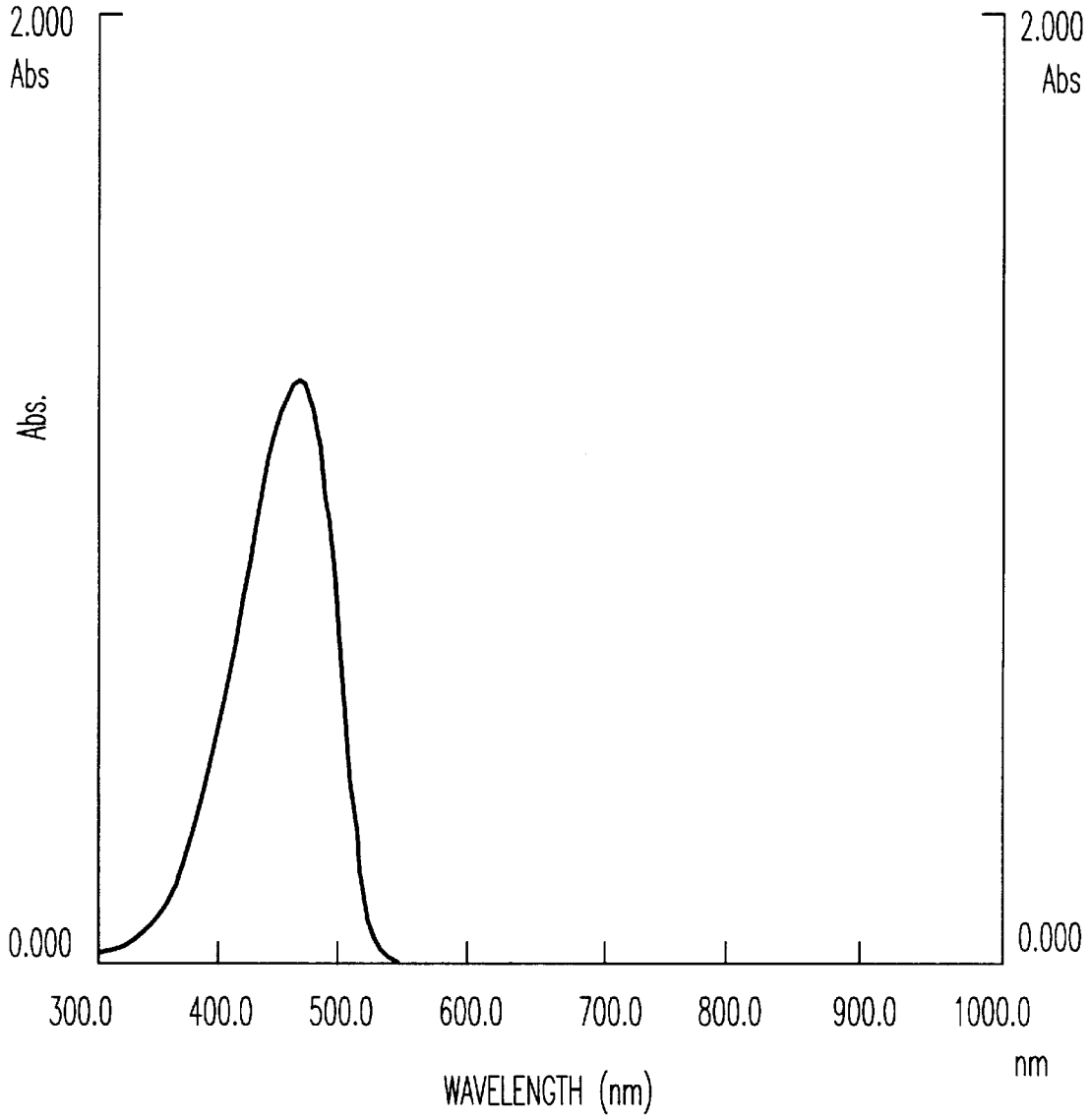
FIG. 14 is a visible light and near-infrared light absorption spectrum of the cyanine compound used in Example 21.

A photoreceptor was prepared in the same manner as in Example 1 except that anthraquinone compound No. 1 used in Example 1 was changed to a cyanine compound of the formula (V) wherein n is 1, X is Cl, $R_1$ is a methyl group and F is F-3 as identified in Table 5. The photoreceptor thus obtained was designated as photoreceptor U. Here, a visible light absorption spectrum of the cyanine compound is shown in FIG. 14. From this spectrum, Abs (700 nm)/Abs (λmax) was calculated to be 0.

EXAMPLE 22

A photoreceptor was prepared in the same manner as in Example 2 except that anthraquinone compound No. 1 used in Example 2 was changed to a cyanine compound of the formula (V) wherein n is 1, X is Cl, $R_1$ is a methyl group and F is F-3 as identified in Table 5. The photoreceptor thus obtained was designated as photoreceptor V.

EXAMPLE 23

Figure 15:
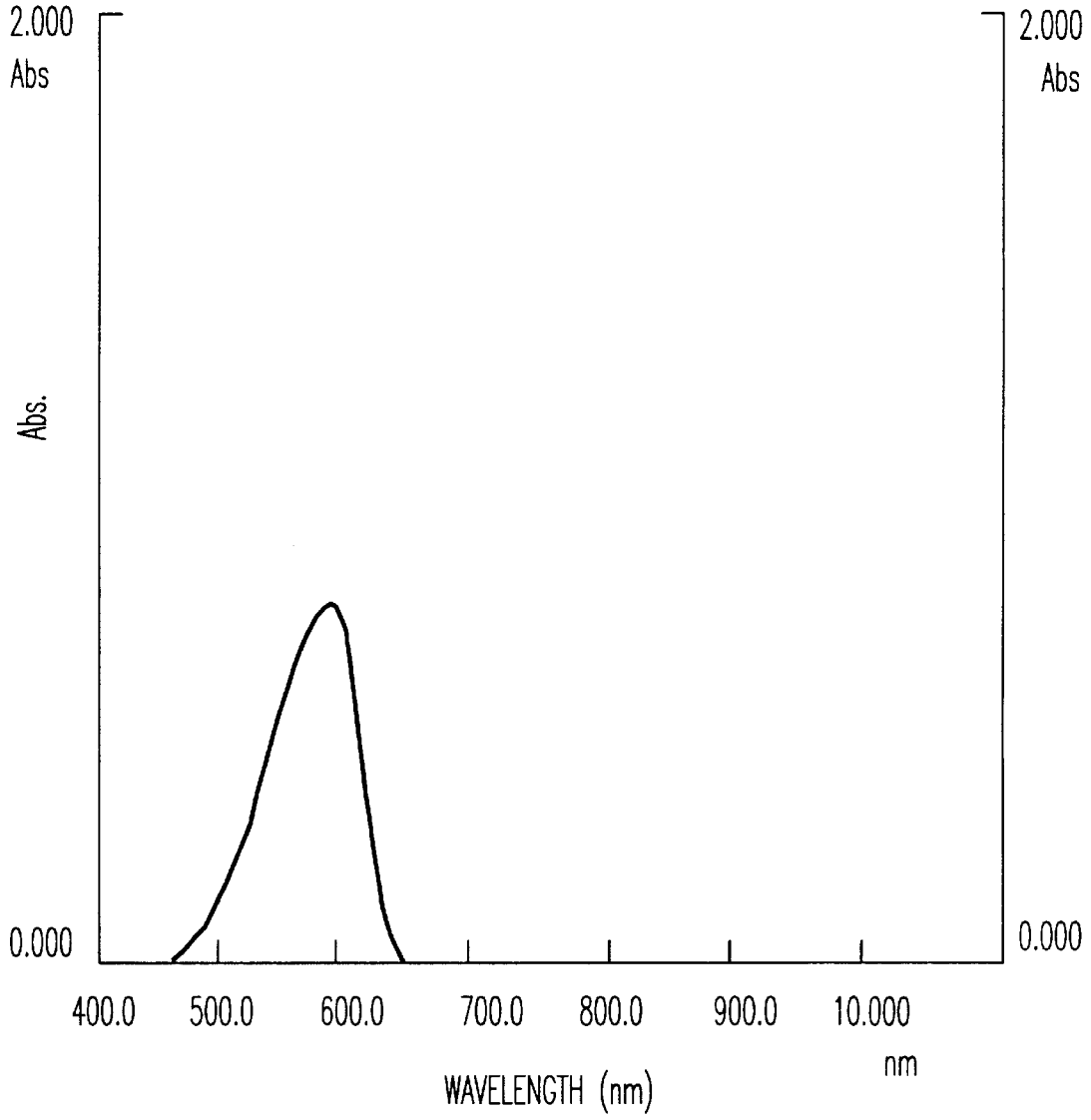
FIG. 15 is a visible light and near-infrared light absorption spectrum of the cyanine compound used in Example 23.

A photoreceptor was prepared in the same manner as in Example 1 except that anthraquinone compound No. 1 used in Example 1 was changed to a cyanine compound of the formula (V) wherein n is 1, X is Cl, $R_1$ is a methyl group and F is F-4 as identified in Table 5. The photoreceptor thus obtained was designated as photoreceptor W. Here, a visible light absorption spectrum of this cyanine compound is shown in FIG. 15. From this spectrum, Abs (700 nm)/Abs (λmax) was calculated to be 0.

EXAMPLE 24

A photoreceptor was prepared in the same manner as in Example 2 except that anthraquinone compound No. 1 used in Example 2 was changed to a cyanine compound of the formula (V) wherein n is 1, X is Cl, $R_1$ is a methyl group and F is F-4 as identified in Table 5. The photoreceptor thus obtained was designated as photoreceptor X.

EXAMPLE 25

Figure 16:
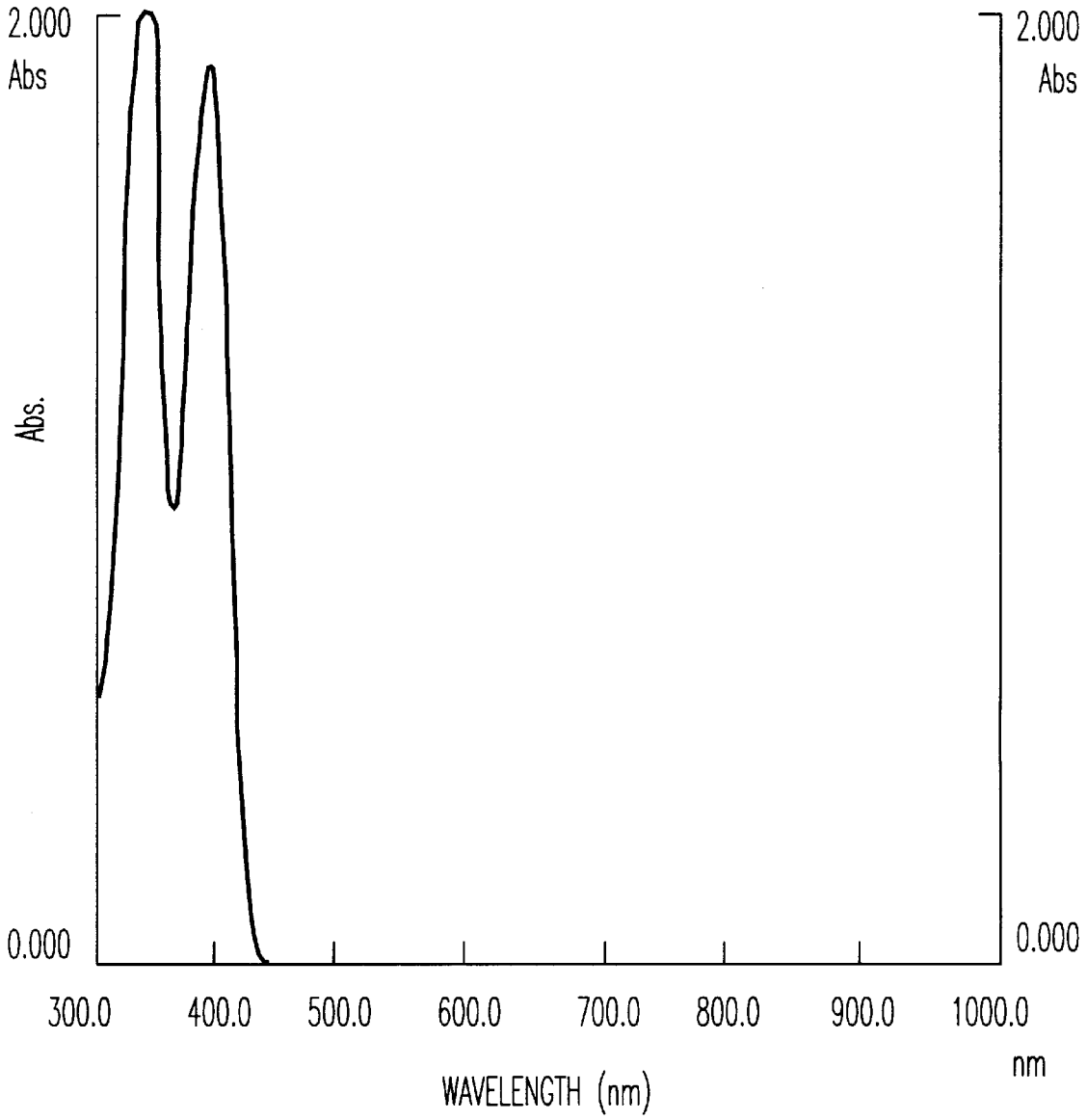
FIG. 16 is a visible light and near-infrared light absorption spectrum of compound No. 4 used in Example 25.
Figure 17:
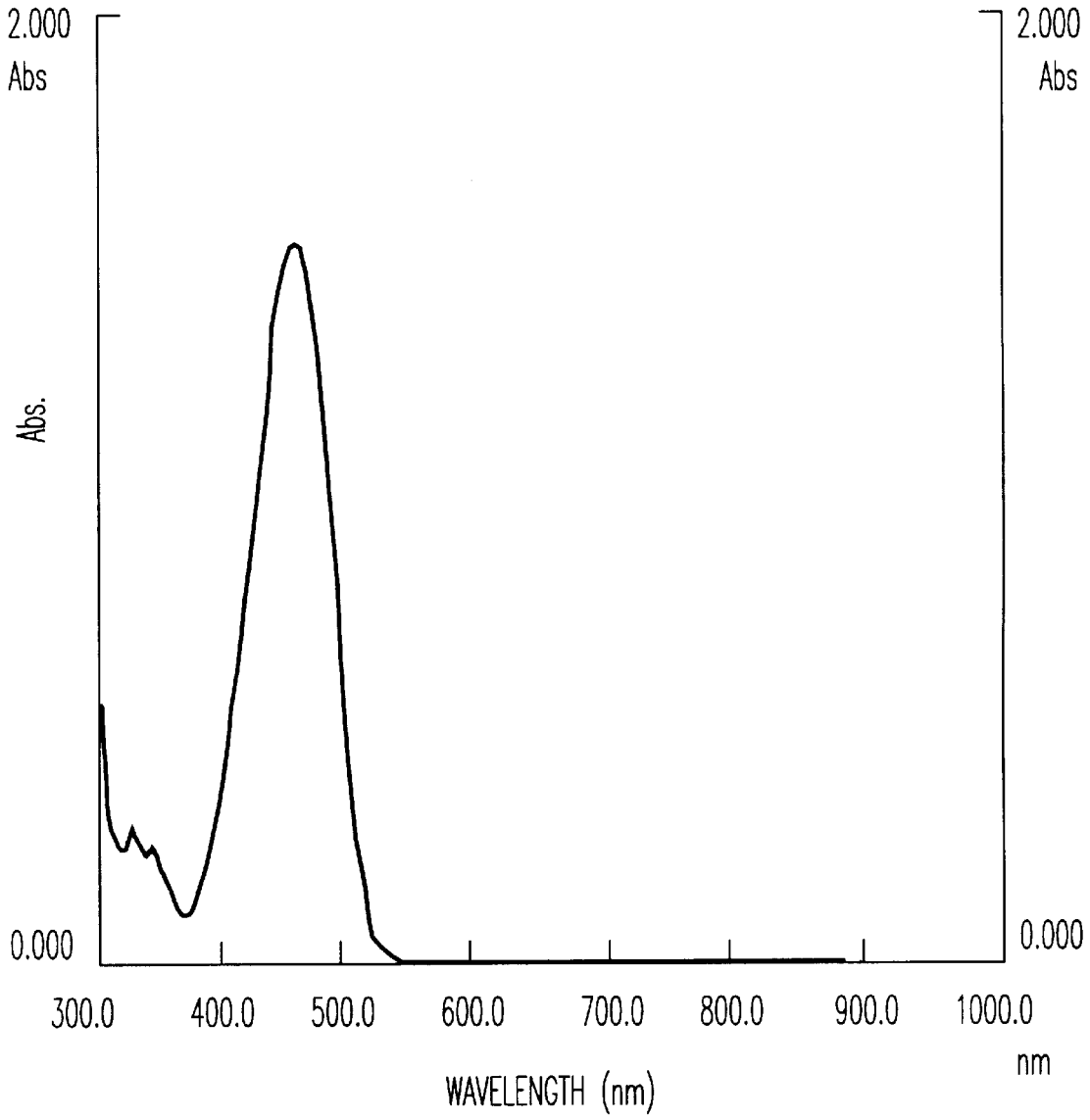
FIG. 17 is a visible light and near-infrared light absorption spectrum of compound No. 9 used in Example 27.

A photoreceptor was prepared in the same manner as in Example 1 except that anthraquinone compound No. 1 used in Example 1 was changed to compound No. 4 as identified in Table 6 in the formula (VI). The photoreceptor thus obtained was designated as photoreceptor Y. Here, a visible light absorption spectrum of the compound is shown in FIG. 16. From this spectrum, Abs (700 nm)/Abs (λmax) was calculated to be 0.

EXAMPLE 26

A photoreceptor was prepared in the same manner as in Example 2 except that anthraquinone compound No. 1 used in Example 2 was changed to compound No. 4 as identified in Table 6 in the formula (VI). The photoreceptor thus obtained was designated as photoreceptor Z.

EXAMPLE 27

A photoreceptor was prepared in the same manner as in Example 1 except that anthraquinone compound No. 1 used in Example 1 was changed to compound No. 9 as identified in Table 6 in the formula (VI). The photoreceptor thus obtained was designated as photoreceptor AA. Here, a visible light absorption spectrum of the compound is shown in FIG. 16. From this spectrum, Abs (700 nm)/Abs (λmax) was calculated to be 0.

EXAMPLE 28

A photoreceptor was prepared in the same manner as in Example 2 except that anthraquinone compound No. 1 used in Example 2 was changed to compound No. 9 as identified in Table 6 in the formula (VI). The photoreceptor thus obtained was designated as photoreceptor AB.

Comparative Example 1

A photoreceptor was prepared in the same manner as in Example 1 except that 10 parts by weight of oxytitanium phthalocyanine was used instead of 2 parts by weight of oxytitanium phthalocyanine and 8 parts by weight of anthraquinone compound No. 1 used in Example 1. The photoreceptor thus obtained was designated as comparative photoreceptor RA.

Comparative Example 2

A photoreceptor was prepared in the same manner as in Example 7 except that 10 parts by weight of oxytitanium phthalocyanine was used instead of 9 parts by weight of oxytitanium phthalocyanine and 1 part by weight of anthraquinone compound No. 1 used in Example 7. The photoreceptor thus obtained was designated as comparative photoreceptor RB.

Comparative Example 3

A photoreceptor was prepared in the same manner as in Example 1 except that 10 parts by weight of anthraquinone compound No. 1 was used instead of 2 parts by weight of oxytitanium phthalocyanine and 8 parts by weight of anthraquinone compound No. 1 used in Example 1. The photoreceptor thus obtained was designated as comparative photoreceptor RC.

Comparative Example 4

A photoreceptor was prepared in the same manner as in Example 3 except that 10 parts by weight of anthraquinone compound No. 3 was used instead of 2 parts by weight of oxytitanium phthalocyanine and 8 parts by weight of anthraquinone compound No. 3 used in Example 3. The photoreceptor thus obtained was designated as comparative photoreceptor RD.

Comparative Example 5

A photoreceptor was prepared in the same manner as in Example 5 except that 10 parts by weight of anthraquinone compound No. 12 was used instead of 2 parts by weight of oxytitanium phthalocyanine and 8 parts by weight of anthraquinone compound No. 12 used in Example 5. The photoreceptor thus obtained was designated as comparative photoreceptor RE.

Comparative Example 6

A photoreceptor was prepared in the same manner as in Example 9 except that 10 parts by weight of azolake compound No. 1 was used instead of 2 parts by weight of oxytitanium phthalocyanine and 8 parts by weight of azolake compound No. 1 used in Example 9. The photoreceptor thus obtained was designated as comparative photoreceptor RF.

Comparative Example 7

A photoreceptor was prepared in the same manner as in Example 11 except that 10 parts by weight of azolake compound No. 2 was used instead of 2 parts by weight of oxytitanium phthalocyanine and 8 parts by weight of azolake compound No. 2 used in Example 11. The photoreceptor thus obtained was designated as comparative photoreceptor RG.

Comparative Example 8

A photoreceptor was prepared in the same manner as in Example 13 except that 10 parts by weight of triarylmethane compound compound No. 1 was used instead of 2 parts by weight of oxytitanium phthalocyanine and 8 parts by weight of triarylmethane compound No. 1 used in Example 13. The photoreceptor thus obtained was designated as comparative photoreceptor RH.

Comparative Example 9

A photoreceptor was prepared in the same manner as in Example 15 except that 10 parts by weight of triarylmethane compound No. 2 was used instead of 2 parts by weight of oxytitanium phthalocyanine and 8 parts by weight of triarylmethane compound No. 2 used in Example 15. The photoreceptor thus obtained was designated as comparative photoreceptor RI.

Comparative Example 10

A photoreceptor was prepared in the same manner as in Example 17 except that 10 parts by weight of an azo compound of the formula (IV) wherein D and E have structures of No. 2 and No. 15 as identified in Table 4, instead of 2 parts by weight of oxytitanium phthalocyanine and 8 parts by weight of the azo compound used in Example 17. The photoreceptor thus obtained was designated as comparative photoreceptor RJ.

Comparative Example 11

A photoreceptor was prepared in the same manner as in Example 19 except that 10 parts of an azo compound of the formula (IV) wherein D and E have structures of No. 1 and No. 27 as identified in Table 4, instead of 2 parts by weight of oxytitanium phthalocyanine and 8 parts by weight of the azo compound used in Example 19. The photoreceptor thus obtained was designated as comparative photoreceptor RK.

Comparative Example 12

A photoreceptor was prepared in the same manner as in Example 21 except that 10 parts by weight of a cyanine compound of the formula (V) wherein n is 1, X is Cl, $R_1$ is a methyl group, and F is F-3 as identified in Table 5, was used instead of 2 parts by weight of oxytitanium phthalocyanine and 8 parts by weight of the cyanine compound used in Example 21. The photoreceptor thus obtained was designated as comparative photoreceptor RL.

Comparative Example 13

A photoreceptor was prepared in the same manner as in Example 23 except that 10 parts of a cyanine compound of the formula (V) wherein n is 1, X is Cl, $R_1$ is a methyl group, and F is F-3 as identified in Table 5, was used instead of 2 parts by weight of oxytitanium phthalocyanine and 8 parts by weight of the cyanine compound used in Example 23. The photoreceptor thus obtained was designated as comparative photoreceptor RM.

Comparative Example 14

A photoreceptor was prepared in the same manner as in Example 25 except that 10 parts by weight of compound No. 4 as identified in Table 6 in the formula (VI) was used instead of 2 parts by weight of oxytitanium phthalocyanine and 8 parts by weight of compound No. 4 used in Example 25. The photoreceptor thus obtained was designated as comparative photoreceptor RN.

Comparative Example 15

A photoreceptor was prepared in the same manner as in Example 27 except that 10 parts of compound No. 4 as identified in Table 6 in the formula (VI) was used instead of 2 parts by weight of oxytitanium phthalocyanine and 8 parts by weight of compound No. 4 used in Example 27. The photoreceptor thus obtained was designated as comparative photoreceptor RN.

Evaluation

With respect to the obtained photoreceptors, half value exposure sensitivities of photoreceptors A, B, C, D, E, F, G, H, I, J, K, L, M, N, O, P, Q, R, S, T, U, V, W, X, Y, Z, AA, AB, AB, RA and RB were measured as initial electrical properties by an electrostatic copying test apparatus (model EPA-8100, manufactured by Kawaguchi Denki Seisakusho). Namely, in a dark place, a photoreceptor was negatively charged by a corona current of 36 mA to a charged voltage (V0). Then, a 780 nm monochromatic light was continuously irradiated, whereby the exposure (El/2) required for the drop of the surface potential from −700 V to −350 V and the residual potential (Vr) were measured. Here, with respect to the one, of which the charged potential did not reach −700 V, the exposure required for the drop of the charged potential to one half was calculated. Further, with respect to photoreceptors RC, RD, RE, RF, RG, RH, RI, RJ, RK, RL, RM, RN and RO, the measurements were carried out in the same manner except that the light source for exposure was changed to white light instead of the 780 nm monochromatic light. The results are shown in Table 7.

TABLE 7

| Photo-receptor | Vo(V) | E/2(uJ/cm2) | Vr(V) | Comparative Photo-ceptor | Vo(V) | E/2(uJ/cm 2) | Vr(V) |
|---|---|---|---|---|---|---|---|
| A | −743 | 0.44 | −15 | RA | −730 | 0.1 | −20 |
| B | −742 | 0.15 | −20 | RB | −725 | 0.52 | −39 |
| C | −708 | 0.38 | −4 | RC | −748 | — | −544 |
| D | −722 | 0.12 | −3 | RD | −722 | — | −562 |
| E | −743 | 0.29 | −20 | RE | −725 | — | −483 |
| F | −736 | 0.13 | −21 | RF | −914 | 27.68 | −28 |
| G | −721 | 0.98 | −36 | RG | −951 | 15.52 | −18 |
| H | −722 | 1.14 | −40 | RH | −1116 | — | −991 |
| I | −732 | 0.25 | −11 | RI | −553 | — | −41 |
| J | −762 | 0.13 | −13 | RJ | −906 | — | −493 |
| K | −762 | 0.31 | −14 | RK | −691 | — | −409 |
| L | −742 | 0.14 | −11 | RL | −749 | 49.73 | −165 |
| M | −764 | 0.27 | −16 | RM | −731 | 55.28 | −182 |
| N | −729 | 0.12 | −14 | RN | −976 | — | −890 |
| O | −741 | 0.31 | −11 | RQ | −833 | — | −598 |
| P | −747 | 0.11 | −11 | | | | |
| Q | −718 | 0.27 | −20 | | | | |
| R | −773 | 0.13 | −21 | | | | |
| S | −449 | 0.2 | −6 | | | | |
| T | −545 | 0.11 | −8 | | | | |
| U | −602 | 0.16 | −2 | | | | |
| V | −657 | 0.11 | −3 | | | | |
| W | −539 | 0.18 | −6 | | | | |
| X | −568 | 0.11 | −3 | | | | |
| Y | −758 | 0.26 | −9 | | | | |
| Z | −735 | 0.13 | −12 | | | | |
| AA | −743 | 0.25 | −6 | | | | |
| AB | −770 | 0.11 | −7 | | | | |

From Table 7, it is evident that photoreceptors RC, RD, RE, RH, RJ, RK and RN do not have carrier generating ability, as the difference between the charged potential and the residual potential represents a potential drop due to dark decay. Photoreceptors RF, RG, RI, RL, RM and RO have a slight sensitivity to white light, but the value is at least 10 Lux·sec, which can not be regarded as a practical sensitivity. On the other hand, photoreceptors A, B, C, D, E, F, G, H, I, J, K, L, M, N, O, P, Q, R, S, T, U, V, W, X, Y, Z, AA and AB have high sensitivities to the 780 nm monochromatic light and their residual potentials are substantially equal or low as compared with photoreceptors RA and RB, thus indicating that no deterioration in the properties has been brought about by mixing the coloring matter of the present invention to the oxytitanium phthalocyanine. Further, from comparison of photoreceptors having the blend ratio of the coloring matter varied, for example, from comparison of A, B and RA or from comparison of G, H and RB, it is evident that by changing the blend ratio of the coloring matter of the present invention to the oxytitanium phthalocyanine, the sensitivity can freely be controlled over a wide range.

As described in the foregoing, according to the present invention, it is possible to adjust the sensitivity of an electrophotographic photoreceptor to the sensitivity required for a light source for exposure so that the image will be sharp in an image-forming process comprising a step of forming an electrostatic latent image by spot exposure with an exposure beam and a step of developing the electrostatic latent image with a developer, whereby it is possible to provide an electrophotographic photoreceptor which is capable of solving a problem with respect to the resolution or with respect to broadening or narrowing of letters and which is suitable for an image-forming process to obtain an image of high quality.

We claim:

1. An electrophotographic photoreceptor comprising an electroconductive substrate and at least a photosensitive layer formed on the substrate, wherein the photosensitive layer contains a carrier generation material having a sensitivity in a near-infrared wavelength region and a coloring matter having no carrier generation ability having no substantial sensitivity in a visible light region and a near-infrared wavelength region, wherein the coloring matter is an anthraquinone compound having at least two hydroxyl groups, an azolake compound, a triarylmethane compound having at least one amino group, a monoazo compound having at least one coupler having a phenolic hydroxyl group, a cyanine compound having an indoline ring as a hetero ring, or a naphthalic acid imide compound.

2. The electrophotographic photoreceptor according to claim 1, wherein the carrier generation material is a phthalocyanine pigment.

3. The electrophotographic photoreceptor according to claim 1, wherein the carrier generation material is oxytitanium phthalocyanine.

4. The electrophotographic photoreceptor according to claim 1, wherein the coloring matter has a half value exposure sensitivity in a visible light region and in a near-infrared wavelength region of at least 10 Lux·sec.

5. The electrophotographic photoreceptor according to claim 1, wherein in the visible light and infrared-light absorption spectrum of the coloring matter, the maximum absorption wavelength (λmax) is within a range of from 350 nm to 650 nm, and the absorbance at 700 nm (Abs (700 nm) and the absorbance at λmax (Abs (λmax)) satisfy a relation represented by the following formula:

$$\text{Abs (700 nm)}/\text{Abs }(\lambda\text{max}) \leqq 0.1.$$

6. The electrophotographic photoreceptor according to claim 1, wherein the mixing ratio of the coloring matter to the carrier generation material is within a range of from 0.01 to 10 parts by weight of the coloring matter to 1 part by weight of the carrier generation material.

7. The electrophotographic photoreceptor according to claim 1, wherein the coloring matter is an anthraquinone compound of the following formula (I):

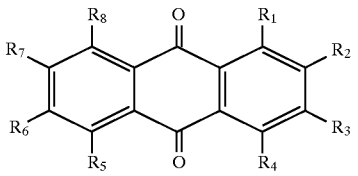

(I)

wherein each of $R_1$ to $R_8$ is a hydrogen atom, a hydroxyl group, a substituted or unsubstituted alkyl group, a substituted or unsubstituted alkoxy group, a substituted or unsubstituted phenoxy group, a substituted or unsubstituted amino group, a sulfonic acid group, a sulfonate group or a halogen atom, provided that at least two of $R_1$ to $R_8$ is a hydroxyl group.

8. The electrophotographic photoreceptor according to claim 1, wherein the coloring matter is an azo chelate compound of the following formula (II):

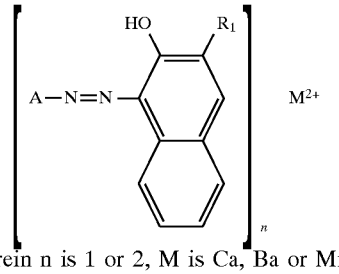

(II)

wherein n is 1 or 2, M is Ca, Ba or Mn, $R_1$ is a hydrogen atom, $SO_3^-$ or $COO^-$, and A is a coupler residue of the following formula (B) or (C):

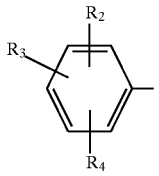

(B)

wherein $R_2$ is a hydrogen atom, a $SO_3^-$ or $COO^-$, each of $R_3$ and $R_4$ is a hydrogen atom, a halogen atom, a substituted or unsubstituted $C_{1-4}$ alkyl group,

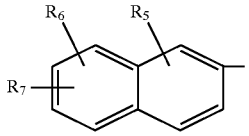

(C)

wherein $R_5$ is a hydrogen atom, $SO_3^-$ or $COO^-$, and each of $R_6$ and $R_7$ is a hydrogen atom, a halogen atom, a substituted or unsubstituted $C_{1-4}$ alkyl group.

9. The electrophotographic photoreceptor according to claim 1, wherein the coloring matter is a triaryl methane compound of the following formula (III):

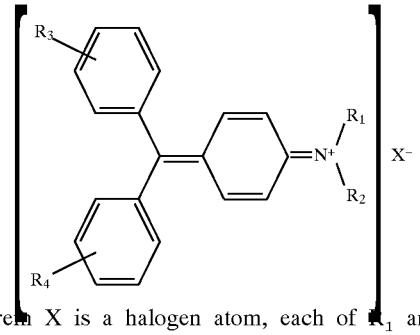

(III)

wherein X is a halogen atom, each of $R_1$ and $R_2$ is a hydrogen atom, a substituted or unsubstituted $C_{1-4}$ alkyl group, and each of $R_3$ and $R_4$ is a hydrogen atom, a halogen atom or a substituted or unsubstituted amino group.

10. The electrophotographic photoreceptor according to claim 1, wherein the coloring matter is a monoazo compound of the following formula (IV):

$$\text{D—N=N—E} \qquad \text{(IV)}$$

wherein each of D and E is a substituted or unsubstituted aromatic ring, a substituted or unsubstituted aromatic hetero ring or a substituted or unsubstituted condensed polycyclic residue, provided that D and E may be the same or different.

11. The electrophotographic photoreceptor according to claim 1, wherein the coloring matter is a cyanine compound of the following formula (V):

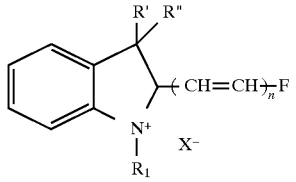

(V)

wherein n is 0, 1 or 2, X is a halogen atom, $CH_3SO_4^-$ or $CH_3C_6H_4SO_4^-$, $R_1$ is a hydrogen atom or a substituted or unsubstituted $C_{1-4}$ alkyl group, each of R' and R" is a substituted or unsubstituted $C_{1-3}$ alkyl group, and F is a residue of the following formula (G), (H) or (I):

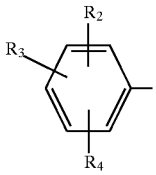

(G)

wherein $R_2$, $R_3$ and $R_4$ is a hydrogen atom, a halogen atom, a substituted or unsubstituted $C_{1-4}$ alkoxy group, a substituted or unsubstituted $C_{1-4}$ alkyl group or a substituted or unsubstituted amino group,

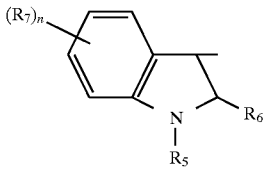

(H)

wherein each of $R_5$ and $R_6$ is a hydrogen atom or a substituted or unsubstituted $C_{1-4}$ alkyl group, $R_7$ is a hydrogen atom, a halogen atom, a substituted or unsubstituted $C_{1-4}$ alkoxy group, a substituted or unsubstituted $C_{1-4}$ alkyl group or a substituted or unsubstituted amino group, n is an integer of from 0 to 4,

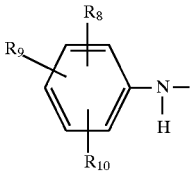

(I)

wherein each of $R_8$, $R_9$ and $R_{10}$ is a hydrogen atom, a halogen atom, or a substituted or unsubstituted $C_{1-4}$ alkoxy group, a substituted or unsubstituted $C_{1-4}$ alkyl group or a substituted or unsubstituted amino group.

12. The electrophotographic photoreceptor according to claim 1, wherein the coloring matter is a compound of the following formula (VI):

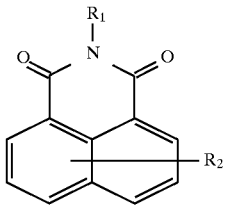

(VI)

wherein each of $R_1$ and $R_2$ is a hydrogen atom, a hydroxyl group, a substituted or unsubstituted $C_{1-4}$ alkyl group, a substituted or unsubstituted $C_{1-4}$ alkoxy group, a substituted or unsubstituted aryl group or a substituted or unsubstituted amino group.

* * * * *